US007959709B2

(12) United States Patent
Numata et al.

(10) Patent No.: US 7,959,709 B2
(45) Date of Patent: Jun. 14, 2011

(54) METHOD OF PRODUCING STEEL FOR STEEL PIPE EXCELLENT IN SOUR-RESISTANCE PERFORMANCE

(75) Inventors: Mitsuhiro Numata, Kamisu (JP); Shingo Takeuchi, Kashima (JP); Tomohiko Omura, Kishiwada (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/629,182

(22) Filed: Dec. 2, 2009

(65) Prior Publication Data

US 2010/0071509 A1 Mar. 25, 2010

Related U.S. Application Data

(63) Continuation of application No. PCT/JP2008/063151, filed on Jul. 23, 2008.

(30) Foreign Application Priority Data

Nov. 14, 2007 (JP) ..... 2007-295111

(51) Int. Cl.

| | |
|---|---|
| ***C21C 5/28*** | (2006.01) |
| ***C21C 7/064*** | (2006.01) |
| ***C21C 7/072*** | (2006.01) |
| ***C21C 7/10*** | (2006.01) |

(52) U.S. Cl. ..... 75/570; 75/548; 75/512; 75/558; 420/590

(58) Field of Classification Search ..... 75/548, 75/558, 512, 567, 570; 420/590

See application file for complete search history.

(56) References Cited

U.S. PATENT DOCUMENTS

| | | | | |
|---|---|---|---|---|
| 4,726,839 | A * | 2/1988 | Berger et al. | 75/10.1 |
| 5,609,199 | A * | 3/1997 | Kato et al. | 164/473 |
| 6,190,435 | B1 * | 2/2001 | Miyamoto et al. | 75/511 |
| 6,264,716 | B1 * | 7/2001 | Kemeny et al. | 75/10.13 |
| 6,344,093 | B1 * | 2/2002 | Ohmori et al. | 148/320 |
| 2007/0217942 | A1 | 9/2007 | Kushida et al. | |

FOREIGN PATENT DOCUMENTS

| | | |
|---|---|---|
| EP | 1 719 821 | 11/2006 |
| JP | 56-98415 | 8/1981 |
| JP | 6-330139 | 11/1994 |
| JP | 9-31524 | 2/1997 |
| JP | 9-209025 | 8/1997 |
| JP | 2001-11528 | 1/2001 |
| JP | 2002-60893 | 2/2002 |
| JP | 2003-313638 | 11/2003 |
| JP | 2004-124158 | 4/2004 |

(Continued)

*Primary Examiner* — George Wyszomierski
*Assistant Examiner* — Tima M McGuthry-Banks
(74) *Attorney, Agent, or Firm* — Clark & Brody

(57) ABSTRACT

A method of producing steel pipe excellent in sour-resistance performance, uses comprises controlling the amount of Ca addition charged into molten steel in a ladle according to a N content in the molten steel prior to Ca addition. As a result of the controlling step, a CaO content in the inclusions is in the range of 30 to 80%, the ratio of the N content in the steel to the CaO content in the inclusions satisfies the relation expressed by equation (1), and a CaS content in the inclusions satisfies the relation expressed by equation (2).

$$0.28 \leq [N]/(\%\ CaO) \leq 2.0 \quad (1)$$

$$(\%\ CaS) \leq 25\% \quad (2)$$

where [N] represents the mass content (ppm) of N in the steel, (% CaO) represents the mass content (%) of CaO in the inclusions, and (% CaS) represents the mass content (%) of CaS in the inclusions.

2 Claims, 2 Drawing Sheets

FOREIGN PATENT DOCUMENTS

| | | |
|---|---|---|
| JP | 2004-315963 | 11/2004 |
| JP | 2005-60820 | 3/2005 |
| JP | 2007-277647 | 10/2007 |
| RU | 2 228 367 | 5/2004 |
| WO | 2005/075694 | 8/2005 |
| WO | 2007/116939 | 10/2007 |

* cited by examiner

METHOD OF PRODUCING STEEL FOR STEEL PIPE EXCELLENT IN SOUR-RESISTANCE PERFORMANCE

This application is a continuation of International Patent Application No. PCT/JP20081063151, filed Jul. 23, 2008. This PCT application was not in English as published under PCT Article 21(2).

TECHNICAL FIELD

The present invention relates to a method of melting and refining an extra-low-sulfur high-cleanliness steel excellent in corrosion resistance, and particularly to a method of melting and refining steel for high-strength steel pipes improved in sour-resistance performance by controlling a chemical composition of non-metallic inclusions in steel, specifically by decreasing the effect of carbonitrides.

BACKGROUND ART

Conventionally, hydrogen-induced cracking resistance (HIC resistance) and sulfide stress corrosion cracking resistance (SSCC resistance), and the like have been required for materials for line pipes. Steel excellent in these properties are called HIC resistant steel, sour-resistant steel, and the like.

Up to now, an inclusions-morphology control technology by Ca treatment has been developed to improve this HIC resistance performance. The initial object of Ca treatment was to inhibit HIC attributable to MnS by morphing MnS as sulfide into Ca-type inclusions. However, it came to light that HIC is attributed to Ca-type oxide and sulfide inclusions (oxysulfide inclusions) other than MnS, for example, inclusions represented by Ca—Al—O—S, Ca—S, and Ca—S—O. And, the need for morphology control of Ca-type oxysulfides in addition to MnS has been recognized. Thus, many technologies that attempt to control inclusions-morphology have been developed. For instance, Japanese Patent Application Publication No. 56-98415, etc. discloses steel production methods that decrease the number of inclusions.

In addition, as the environment of pipes in use become hostile, further enhancement of sour-resistance performance and higher strength are demanded and the development of inclusions-morphology control technology is also conducted to satisfy the demand. Japanese Patent Application Publication No. 06-330139 discloses a method of controlling inclusions that involves adding Ca, Al and Si so as to satisfy a specified relational expression for steel types of X42 to 65 grades of API Standards.

Meanwhile, in recent years, much higher sour-resistance performance and strength in steel have been demanded and more advanced technology development has been pursued. Japanese Patent Application Publication No. 2005-60820 discloses a technology that improves sour-resistance performance by attempting the dispersion of carbonitrides for a steel grade equal to or higher than the X65 grade of API Standards. In addition, Japanese Patent application Publication No. 2003-313638 discloses steel obtained by dispersing and depositing precipitates including Ti and W for a similar steel type which is equal to or higher than the X65 grade of API Standards. Moreover, Japanese Patent Application Publication No. 2001-11528 discloses a method for melting and refining steels that controls the composition of Ca—Al—O—S-type inclusions by adjusting the amount of Ca addition such that the Ca concentration satisfies a predetermined relation according to the S and O concentrations in molten steel.

Then, the present inventors found that bulky TiN-type inclusions exceeding 30 μm in size become the initiation point of HIC and proposed steel in which these are reduced and a method of controlling the size of TiN to 10 to 30 μm by use of Ca—Al-type inclusions in WO2005/075694.

As described above, the morphology control technology for inclusions by Ca treatment has been upgraded according to performance demand for steel, and the technology has been developed from simple addition of Ca to inhibiting CaS generation and improving cleanliness to controlling composition of Ca-type inclusions and further to the fine dispersion and precipitation of carbonitride-type inclusions.

Incidentally, recently, higher sour-resistance performance and strength have been demanded as previously described. For these demands, following problems are present. A first problem is to address the instability of sour-resistance performance. In other words, the technology intended for high-strength steel is for the dispersion of carbonitrides and the composition control of Ca-type inclusions. Although the technology can control the generation of HIC to the low level, HIC still happened to generate in some cases. In addition, a second problem is to cope with the difficulty of completely inhibiting the generation of HIC even by applying rigorous conditions in Ca treatment. The prior art has been primarily directed to optimization of Ca treatment conditions. However, though the Ca treatment conditions are rigorously managed in high strength steel, there is still a problem in that the complete inhibition of HIC generation is difficult.

Although the above-mentioned problems imply the possibility of the presence of proper production conditions to be controlled other than proper conditions for Ca treatment, their detailed contents and approaches have been quite uncertain and solutions of these problems has been difficult.

DISCLOSURE OF THE INVENTION

As described above, in conventional sour-resistant steel and the production method thereof, it is difficult to obtain stable sour-resistant steel, so that the establishment of stabilization technique for sour-resistant steel has been a problem to be solved. Although the prior art has been mainly directed to the control of Ca-type inclusions and carbonitride-type inclusions, the control thereof is insufficient to obtain stable sour-resistant steel.

The present invention has been made in consideration of the above-described problems, and a subject thereof is to provide a method of producing steel for a steel pipe improved and stabilized in sour-resistance performance by identifying the cause of generation of HIC in terms of phenomena.

The present invention has been made to complete the above-described subject. The gist of the invention includes a method of producing steel for a steel pipe excellent in sour-resistance performance shown in (1) to (4) below.

(1) A method of producing steel for a steel pipe excellent in sour-resistance performance, the steel comprising, in % by mass, C, 0.03 to 0.4%, Mn: 0.1 to 2%, Si: 0.01 to 1%, P: 0.015% or less, S: 0.002% or less, Ti: 0.2% or less, Al: 0.005 to 0.1%, Ca: 0.0005 to 0.0035%, N: 0.01% or less, and O (oxygen): 0.002% or less, the balance being Fe and impurities, in which the amount of Ca addition of Ca into molten steel in a ladle, where the non-metallic inclusions in the steel includes Ca, Al, O and S as main components, is controlled according to the N content in the molten steel prior to addition of Ca such that the CaO content in the inclusions is in the range of 30 to 80%, the ratio of the N content in the steel to the CaO content in the inclusions satisfies the relation expressed by equation (1) below, and the CaS content in the inclusions satisfies the relation expressed by equation (2) below.

$$0.28 \leqq [N]/(\%\ CaO) \leqq 2.0 \quad (1)$$

$$(\%\ CaS) \leqq 25\% \quad (2)$$

where [N] represents the mass content (ppm) of N in the steel, (% CaO) represents the mass content (%) of CaO in the inclusions, and (% CaS) represents the mass content (%) of CaS in the inclusions.

(2) The method of producing steel for a steel pipe excellent in sour-resistance performance described in (1) above, the steel comprising one or more elements selected from one or more of groups (a) to (c) below, in place of a part of Fe:

(a) in % by mass, Cr: 1% or less, Mo: 1% or less, Nb: 0.1% or less, and V: 0.3% or less;

(b) in % by mass, Ni: 0.3% or less, and Cu: 0.4% or less; and (c) in % by mass, B: 0.002% or less.

(3) The method of producing steel for a steel pipe excellent in sour-resistance performance described in (1) or (2) above, in which Ca is added such that in controlling the amount of Ca addition into the molten steel in the ladle, the ratio of the N content in molten steel to the amount of Ca addition to the molten steel satisfies the relation expressed by equation (3) below according to the N content in the molten steel prior to the Ca addition:

$$200 \leqq [N]/WCA \leqq 857 \quad (3)$$

where [N] represents the mass content (ppm) of N in the molten steel prior to the Ca addition and WCA represents the amount of Ca addition (kg/t-molten steel) to the molten steel.

(4) The method of producing steel for a steel pipe excellent in sour-resistance performance described in any one of (1) to (3) above, in which the molten steel is treated by the steps indicated by Steps 1 to 4 below and then the above Ca is added in Step 5 below:

Step 1: CaO-type flux is added to molten steel in a ladle at atmospheric pressure;

Step 2: after Step 1 above, the molten steel and the above CaO flux are stirred by injecting a stirring gas into the molten steel in the ladle at atmospheric pressure, and also an oxidizing gas is supplied to the molten steel to thereby mix the CaO-type flux with an oxide generated by reaction of the oxidizing gas with the molten steel;

Step 3: the supply of the above oxidizing gas is halted and desulfurization and the removal of inclusions are carried out by injecting a stirring gas into the above molten steel in the ladle at atmospheric pressure;

Step 4: an oxidizing gas is supplied into an RH vacuum chamber to increase the molten steel temperature when the above molten steel in the ladle is treated using an RH degasser after Step 3 above, and subsequently the supply of the oxidizing gas is halted, and then the circulation of the molten steel within the RH degasser is continued to remove inclusions in the molten steel; and Step 5: metallic Ca or a Ca alloy is added to the above molten steel in the ladle after Step 4 above.

In the present invention, the term "non-metallic inclusions in the steel include Ca, Al, O, and S as main components" means that the total amount of these contents is 85% by mass or more. Small amounts of Mg, Ti, and Si may be included as other components.

In addition, "CaO-type flux" means the flux in which the CaO content is 45% by mass or more and, for example, the flux mainly containing single quicklime and quicklime-based flux containing components such as $Al_2O_3$ and MgO are pertinent.

An "oxidizing gas" means a gas having the ability of oxidizing alloying elements such as Al, Si, Mn and Fe in the melting temperature range of steel, whereas a single gas such as oxygen gas or carbon dioxide gas, a mixed gas of these single gases and a blended gas of the above gases with inert gas or nitrogen are pertinent.

Additionally, in the descriptions below, the "in % by mass" representing the constituent content is also simply expressed by "%". Moreover, the "t-molten steel" representing one ton of molten steel is also simply expressed by "t".

The present inventors have discussed a method of producing steel for a steel pipe improved and stabilized in sour-resistance performance to complete the foregoing subject, obtained findings described below, and completed the above-described present invention.

1. Chemical Composition of Steel for a Steel Pipe and Inclusions in Steel 1-1. Chemical Composition of Steel for Steel Pipe As described above, conventionally, even if the improvement of cleanliness of steel and the morphology control of Ca-type inclusions or, in addition thereto, the increase of strength by dispersion/deposition of carbonitrides was attempted, there still exists many unidentified causes of rendering sour-resistance performance unstable. This fact suggests that sour-resistance performance may deteriorate due to causative factors other than oxysulfides or sulfides including Ca-type inclusions, MnS and CaS, or bulky TiN.

Thus, the present inventors have fully investigated the initiation point of HIC. First described is the reason why the present invention is limited to such a steel composition that comprises C, 0.03 to 0.4%, Mn: 0.1 to 2%, Si: 0.01 to 1%, P: 0.015% or less, S: 0.002% or less, Ti: 0.2% or less, Al: 0.005 to 0.1%, Ca: 0.0005 to 0.0035%, N: 0.01% or less, and (oxygen): 0.002% or less, and further, where needed, comprises one or more of elements selected from a group consisting of Cr: 1% or less, Mo: 1% or less, Nb: 0.1% or less, V: 0.3% or less, Ni: 0.3% or less, Cu: 0.4% or less, and B: 0.002% or less, the balance being Fe and impurities.

C: 0.03 to 0.4%

C has a function that improves the strength of steel, and is an indispensable constituent element. If the C content is less than 0.03%, a sufficient strength for the steel is not obtained. On the other hand, if the content exceeds 0.4% and becomes high, hardness becomes too high and thus the cracking susceptibility is increased, so that the generation of HIC cannot be sufficiently suppressed. Hence, the proper range of the C content was set to be from 0.03 to 0.4%. The C content preferably ranges from 0.05 to 0.25%.

Mn: 0.1 to 2%

Mn is also an indispensable element to improve the strength of steel. If the Mn content is less than 0.1%, a sufficient strength for the steel is not obtained. On the other hand, if its content exceeds 2% and becomes high, inhibiting the generation of MnS becomes difficult and, at the same time, the compositional segregation becomes notable. Hence, the proper range of the Mn content was set to be from 0.1 to 2%. The preferred range of the content is from 1.2 to 1.8%.

Si: 0.01 to 1%

Si not only functions as a deoxidizing element, but affects activities of Ti and Ca in steel. Therefore, if Si content is less than 0.010, the Ca activity cannot be increased, while if its content exceeds 1% and becomes high, the Ti activity is increased too much, whereby the generation of TiN cannot be suppressed. Accordingly, the proper content range of Si is from 0.01 to 1%. The preferred range of the content is from 0.1 to 0.5%.

P: 0.015% or Less

P is an element that heightens cracking susceptibility since it segregates in steel and increases hardness of steel in a segregation portion. Therefore, the content needs to be set to 0.015% or less. On the other hand, reducing the P content to less than 0.005% leads to an increase in refining costs, so that its content is preferably 0.005% or more from economical aspect.

S: 0.002% or Less

Since S is a constituent element of sulfide-type inclusions that pose a problem in HIC resistant steel, its content is preferably low. If the S content exceeds 0.002% and becomes high, the CaS content in the inclusions becomes high when Ca is added, whereby the relationship between the CaO content and the N content in the inclusions as described below is difficult to be satisfied. Thus, the S content needs to be 0.002% or less. The preferred range of the content is 0.001% or less.

Ti: 0.2% or Less

Ti is an element that precipitates in steel as TiN and has the function of improving toughness of steel. However, excessive addition of Ti leads to the coarsening of TiN to be precipitated. Thus, the Ti content needs to be 0.2% or less. Its content is preferably set to be 0.005% or more from the viewpoint of securing toughness. From the above reasons, the Ti content is preferably 0.005% or more and needs to be 0.2% or less.

Al: 0.005 to 0.1%

Al is an element that has strong deoxidization effect and an important element for lowering an oxygen content in steel. Its content of less than 0.005% is insufficient for deoxidization effect and cannot sufficiently decrease the amount of inclusions. On the other hand, when the Al content exceeds 0.1% and becomes high, the generation of sulfides is aggravated in addition to the saturation of the deoxidization effect. Hence, the proper range of the Al content was set to be from 0.005 to 0.1%. The preferred range of the content is from 0.008 to 0.04%.

Ca: 0.0005 to 0.0035%

Ca is an element that exerts effective action for reforming sulfide inclusions and spheroidizing alumina inclusions. When the Ca content is less than 0.0005%, these effects cannot be obtained and thus the generation of HIC attributable to MnS or alumina clusters cannot be suppressed. On the other hand, when the content exceeds 0.0035% and becomes high, a CaS cluster may be generated. Hence, the proper range of the Ca content was set to be from 0.0005 to 0.0035%. The content preferably ranges from 0.0008 to 0.002%.

N: 0.01% or Less

N is an element that constitutes bulky TiN, so that its content is preferably low. When the N content exceeds 0.01% and becomes high, the generation temperature of TiN rises and becomes near a steel refining temperature or a casting temperature, so that the coarsening of TiN cannot be restrained. Hence, the proper range of the N content was set to be 0.01% or less. On the other hand, its content is preferably 0.0015% or more from an economical viewpoint. Moreover, its content is preferably 0.005% or less to particularly improve toughness.

O (Oxygen): 0.002% or Less

The O content means the total oxygen content (T. [O]) that includes the oxygen contained in oxide-type inclusions and serves as a measure of the amount of inclusions. When this content exceeds 0.002% and becomes high, the amount of inclusions becomes too big and the suppression of generation of HIC in high-strength steel becomes difficult. The lower the O content, the smaller the amount of oxide-type inclusions. However, its content is preferably set in the range of 0.0003 to 0.0015% in order to readily satisfy the relationship between the CaO content in inclusions described below and the N content in steel.

The above covers essential compositional elements in steel for a steel pipe and their composition ranges in the present invention, and one or more of elements selected from one or more of groups out of (a) to (c) listed below can be contained according to applications and use environments of steel. In other words, Group (a) includes Cr, Mo, Nb and V; Group (b) includes Ni and Cu; and Group (c) includes B. Elements of each of the above groups may or may not be contained. However, if contained, they can be each contained in the content ranges as below to exhibit their effects.

The elements of Group (a) are Cr, Mo, Nb and V, and have the function of improving strength or toughness of steel.

Cr: 1% or Less

Cr is an element having a function that improves strength of steel. When its effect is pursued by containing Cr, including 0.005% or more enables the above effect to be exhibited. However, if its content exceeds 1% and becomes high, the toughness of the welded portion is decreased. Accordingly, when Cr is to be contained, its content may be in the range of 1% or less. In addition, the Cr content is preferably 0.005% or more.

Mo: 1% or Less

Mo is also an element having a function that improves strength of steel. When its effect needs to be pursued, including 0.01% or more thereof makes it possible to exhibit the above effect. However, if its content exceeds 1% and becomes high, weldability is worsened. Thus, if needed, Mo may be included in the range of 1% or less. Moreover, its content is preferably set in the range of 0.01% or more.

Nb: 0.1% or Less

Nb is an element that has the effect of improving toughness by grain-refining of a steel structure. Including 0.003% or more thereof can exhibit its effect. However, if its content exceeds 0.1% and becomes high, the toughness of a welded portion is decreased. Thus, if needed, Nb may be included in the range of 0.1% or less. In addition, its content is preferably made 0.003% or more.

V: 0.3% or Less

V is also an element that has the effect of improving toughness by grain-refining of a steel structure. Containing V of 0.01% or more enables its effect to be exhibited. However, if its content exceeds 0.3% and becomes high, the toughness of a welded portion is decreased. Thus, if needed, V may be included in the range of 0.3% or less. Moreover, its content is preferably 0.01% or more.

The elements of Group (b) are Ni and Cu, and have the function of suppressing the intrusion of hydrogen in a hydrogen sulfide environment.

Ni: 0.3% or Less

Ni has the function of suppressing the ingress of hydrogen into steel in a hydrogen sulfide environment. When its effect needs to be pursued, containing 0.1% or more of Ni makes it possible to exhibit the above effect. However, since, when its content exceeds 0.3% and becomes high, the effect of suppressing the hydrogen ingress is saturated, the Ni content may be set 0.3% or less. In addition, its content is preferably set in the range of 0.1% or more.

Cu: 0.4% or Less

Cu also has the function of suppressing the ingress of hydrogen into steel in a hydrogen sulfide environment similarly to Ni. When its effect needs to be pursued, containing 0.1% or more of Cu makes it possible to exhibit the above effect. However, since, when its content exceeds 0.4% and becomes high, the steel melts at high temperature, which decreases the strength of grain boundary, if Cu is needed, its content may be set to 0.4% or less. In addition, its content is preferably set in the range of 0.1% or more.

The element of Group (c) is B and has the function of improving hardenability of steel.

B: 0.002% or Less

B is an element that has the effect of improving hardenability of steel. When its effect needs to be pursued, containing 0.0001% or more of B makes it possible to exhibit the above effect. However, since, when its content exceeds 0.002% and becomes high, the hot workability of steel is lowered, if B is needed, its content is set to 0.002% or less. Moreover, its content is preferably made in the range of 0.0001% or more.

1-2. Chemical Composition of Inclusions in Steel

The reasons why the composition of inclusions mainly comprises a Ca—Al—O—S system and a CaO content in inclusions is limited to 30 to 80% will be described.

The presence of Ca—Al—O-type inclusions is indispensable to restrain the generation of MnS, despite that Ca is added to restrain the generation of MnS. In addition, if Ca is not contained, alumina cluster inclusions are formed and become an initiation to generate HIC in some cases. Hence, in the present invention, inclusions were configured to mainly comprise a Ca—Al—O—S system. However, a small amount of MnS, $SiO_2$ and carbonitrides might be generated on surfaces of Ca—Al—O-type inclusions due to composition segregation and temperature decrease during solidification. This does not affect the generation of HIC and thus does not particularly need to be limited.

Next, the range of the CaO content in inclusions will be described. When the CaO content becomes less than 30%, the effect of suppressing the generation of MnS is lowered, and in addition, the melting point of inclusions is increased, thereby likely inducing the clogging of casting nozzles, whereby it becomes difficult to secure stable productivity. On the other hand, if the CaO content in inclusions exceeds 80% and becomes high, the solid phase ratio in inclusions at a molten steel temperature is risen to thereby make it impossible to maintain a spherical shape in inclusions. On account of this, the Ca—Al—O-type inclusions result in a massive or angular shape, which may become an initiation of the generation of HIC.

From the above reasons, the proper range of the CaO content in inclusions was specified in the range of 30 to 80%.

In the present invention, steel compositions were limited as described above, and the relationship between inclusions and the generation of HIC was investigated within the respective content ranges.

1-3. Investigation of Relationship Between Inclusions in Steel and Generation of HIC 200 kg of molten steel was made and adjusted it within the range of the above composition and then tapped into a mold to yield a steel ingot. A test piece was cut out of the resulting steel ingot, and inclusions in the steel was closely observed. Asa result, as described in the above WO2005/075694, bulky TiN was decreased by addition of Ca and the generation of TiN around the Ca—Al—O-type inclusions was observed. Additionally, when no addition of Ca, it was ascertained that many bulky TiN inclusions were generated and at the same time MnS was generated as well.

Moreover, Ca—Al inclusions appear in a spherical shape and neither oxide-type clusters nor CaS clusters were generated. When minuscule inclusions were observed, as described in Japanese Patent Application Publication No. 2003-313638, extremely tiny carbonitrides that are considered not to be pertinent to the generation of HIC were also observed. These results well agree with the results disclosed in the prior art and indicate the validity of the present investigation. As stated above, a variety of inclusions are generated in the sour-resistant steel, the prior art has been directed to mainly controlling these inclusions.

Next, the dispersion states of various inclusions were investigated. As a result, it has been shown that, when Ca is added, Ca-containing oxysulfide-type inclusions are uniformly dispersed, while for titanium-type carbonitrides with a relatively small size of 1 to 10 μm, there exist two patterns, one is that they are uniformly dispersed, the other is that several to tens of them are aggregated/overcrowded within a square area of about 30 to 70 μm in side length. The present inventors have paid attention to titanium-type carbonitrides present in the aggravated state (hereinafter, also noted as a "collective carbonitrides").

The above collective carbonitrides are comprised of tiny carbonitrides of 30 μm or less in size and it is presumed that such a single tiny carbonitride would not lead up to the generation of HIC by virtue of this size. However, it is considered that, when these inclusions are aggregated and appear in a narrow region, the collective carbonitrides behave like a single inclusion, thereby possibly affecting the generation of HIC.

Fundamentally, where this collective carbonitrides cause the generation of HIC, it is important to quantify and evaluate this size. However, small carbonitrides are considered to gather three-dimensionally to form this collective carbonitrides, so that there is a problem in that the size flatly observed does not necessarily correspond to the size of the collective carbonitrides.

Hence, the present inventors discussed a measure that can specify the state of collective carbonitrides with further higher precision. When a single carbonitride of 1 to 10 μm is present in the range of tens of μm without dependency on the size, one collective carbonitrides were judged to be present and the number of collective carbonitrides present on the surface of a test piece of 30 mm×30 mm was measured. As a result, when the number of collective-carbonitride-type inclusions is represented by the N content in steel and the CaO content in the Ca—Al-type oxysulfide inclusions, a correlation was found between HIC resistance performance and the contents.

As described above, though the size or the number of sets of carbonitrides lacks precision, the N content in steel and the CaO concentration in Ca—Al-type oxysulfide inclusions can be determined with high precision. In addition, it is considered that when the N content in steel is high, the generation of the carbonitride is promoted, so that the number of sets of carbonitrides increases and the size also becomes large. Additionally, it is speculated that a proper range in the CaO content in the inclusions is present to generate carbonitrides on surfaces of Ca—Al-type inclusions. Then, the present inventors have considered that the behavior of collective carbonitrides can be analyzed from the ratio of the N content in the steel to the CaO content in the inclusions, or the value of [N]/(% CaO), on the basis of the above results.

Accordingly, 180 kg of molten steel was adjusted to the above steel composition, the strength of the resulting steel ingot is adjusted to the X80 grade of API Standards, and then the HIC resistance performance was evaluated according to the method stipulated in NACE (National Association of Corrosion Engineers) TM0284-2003. Specifically, 10 test pieces each being 10 mm thick×20 mm wide×100 mm long were sampled from each steel ingot thus made, and these were immersed in an aqueous solution (0.5% acetic acid+5% salt) at 25° C. saturated with hydrogen sulfide at $1.013\times10^5$ Pa (1 atm). The area of HIC generated in each test piece after testing was measured by ultrasonic flaw detection, and then the crack area ratio (CAR) was obtained by equation (4) below. Here, the area of the test piece in equation (4) was set to be 20 mm×100 mm.

$$\text{Crack area ratio (CAR)}=(\text{total value of area of HIC generated in test piece/tested area of test piece})\times 100(\%) \quad (4)$$

In this regard, it was judged that the case where the crack area ratio (CAR) was less than 1% was taken as no generation of HIC and that the case where CAR was 1% or more was taken as generation of HIC.

FIG. 1 shows the relationship between [N]/(% CaO) that is the ratio of the N content in steel to the CaO content in inclusions and the number of collective carbonitrides. In addition, FIG. 2 shows the relationship between [N]/(% CaO) that is the ratio of the N content in steel to the CaO content in inclusions and the generation rate of HIC. The results in these FIGS. 1 and 2 are ones that are obtained by examination of steel types of X70 grade in API Standards. Additionally, the generation rate of HIC in FIG. 2 was indicated by the ratio of the number of test pieces that generated HIC out of 30 test pieces sampled from the same steel composition. For example, when HIC is generated in one test piece out of 30 test pieces, the generation rate of HIC is 3.33%.

FIG. 1 shows that, when the CaS content in inclusions is 25% or less, collective carbonitrides are not generated if [N]/(% CaO) as being the ratio of the N content in steel to the CaO content in inclusions is within the range of 0.28 to 2.0 (ppm/% by mass). As a result, as shown in FIG. 2, HIC is completely suppressed when the ratio of the N content in steel to the CaO content in inclusions is within the range of 0.28 to 2.0 (ppm/% by mass). However, when the CaS content in inclusions exceeds 25% and becomes high, the generation of the collective carbonitrides is not suppressed, as shown in FIG. 1, even if the value of [N]/(% CaO) is within the range of 0.28 to 2.0 (ppm/% by mass). As a result, as shown in FIG. 2, HIC is apparently generated.

In other words, it has become apparent that the relations represented by equations (1) and (2) below need to be satisfied at the same time to secure HIC resistance performance in high strength steel.

$$0.28\leqq[N]/(\%\ CaO)\leqq2.0 \quad (1)$$

$$(\%\ CaS)\leqq25\% \quad (2)$$

The above results are indicative that when the N content in steel is too high or when the CaO content in inclusions is not present within a proper range and the two are not properly balanced, the generation of collective carbonitrides cannot be suppressed to thereby cause HIC to be generated. Moreover, it is speculated that CaS tends to be generated on the surface of any of Ca—Al-type oxysulfide inclusions when the CaS content in inclusions exceed 25% and becomes high, thereby inhibiting the generation of carbonitrides onto the surface of any of Ca—Al-type oxysulfide inclusions, resulting in promoting the generation of collective carbonitrides.

The inventions according to claims 1 and 2 to secure HIC resistance performance in high strength steel have been completed on the basis of the findings described in 1-1. to 1-3. above.

2. Balance Between N Content in Molten Steel and Amount of Ca Addition

As described above, properly adjusting the balance between a chemical composition in inclusions and the N content in steel enables to suppress the generation of RIC better than the case in the prior art by. Now, further, a method of more simply and easily obtaining the above type of inclusions will be described. In the present invention, the CaO content in inclusions is controlled by the amount of Ca addition. Besides, there is a need to balance the amount of Ca addition with the N content in molten steel since it is necessary to adjust the balance between the N content in steel and the CaO content in inclusions.

Then, the N content in molten steel prior to Ca addition and the amount of Ca addition were varied using 10 kg of molten steel to thereby investigate the relationship between [N]/WCA as being the ratio of the two and [N]/(% CaO) as being the ratio of the N content in steel to the CaO content in inclusions. The testing was repeated 4 times and its results were evaluated.

FIG. 3 is a diagram indicating the relationship between [N]/WCA and N/(% CaO). In the diagram, [N] in relation to [N]/WCA represents the N content in molten steel (ppm) prior to Ca addition and WCA represents the amount of Ca addition per production unit (kg/t-molten steel) into molten steel.

As indicated in the results of FIG. 3, all four tests satisfied the range of [N]/(% CaO) specified in claim 1 in the range in which the value of [N]/WCA is from 200 to 857 (ppm %/kg). On the other hand, in the range in which the value of [N]/WCA is outside the above, there were cases where some satisfy and the others cannot satisfy the range of [N]/(% CaO) specified in claim 1. From the above results, if the value of [N]/WCA satisfies the conditions expressed by equation (3) below, the value of [N]/(% CaO) satisfies the relation of equation (1) above specified in claim 1, and therefore, steel for a steel pipe can be stably produced by the production method according to claim 1.

$$200\leqq[N]/WCA\leqq857 \quad (3)$$

3. Step of Producing Steel for Steel Pipes

The invention according to claim 4 is an invention that specifies a step of producing steel for a steel pipe. The reason of the limitation for each step will be described in the following. In the present invention, the lower and more stable the N content in molten steel, the more the controllability of inclusions is improved to make it easy to produce steel for a steel pipe by a production method according to claim 1. In addition, the lower and more stable the N content in molten steel, the more the amount of Ca addition can be decreased and the less the production cost can be and at the same time the less the variation of the amount of Ca addition in each treatment can be. Furthermore, as the amount of inclusions in molten steel is lowly stable, the above effects increase all the better. Additionally, the lower the S content in molten steel, the easier the relation of equation (2) specified in claim 1 is satisfied.

Therefore, it is important to optimize melting and refining process of steel and to stabilize cleanliness and the N content in steel in order to further stably produce steel for a steel pipe of the present invention.

In other words, the invention according to claim 4 is a method of refining steel for a steel pipe that promotes desulfurization and purification as well as lowering the N content at the same time to thereby allow the invention according to any of claims 1 to 3 to be carried out efficiently and stably by controlling the temperature-raising process of molten steel as well as by optimizing the stirring treatment of molten steel and slag.

An optimal process in the present invention comprises following Steps 1 to 5:

Step 1: CaO-type flux is added to molten steel in a ladle at atmospheric pressure;

Step 2: after Step 1 above, the molten steel and the above CaO flux are stirred by injecting a stirring gas into the molten steel in the ladle at atmospheric pressure, and also an oxidizing gas is supplied to the molten steel to thereby mix the CaO-type flux with an oxide generated by the reaction of the oxidizing gas with the molten steel;

Step 3: the supply of the above oxidizing gas is halted and desulfurization and the removal of inclusions are carried out by injecting a stirring gas into the above molten steel in the ladle at atmospheric pressure;

Step 4: an oxidizing gas is supplied into an RH vacuum chamber to increase the molten steel temperature when the above molten steel in the ladle is processed using an RH degasser after Step 3 above, and subsequently the supply of the oxidizing gas is halted, and then the circulation of the molten steel within the RH degasser is continued to remove inclusions in the molten steel; and Step 5: metallic Ca or a Ca alloy is added to the above molten steel in the ladle after Step 4 above.

In order to melt and refine an extra-low-sulfur high-cleanliness steel that simultaneously achieves extra-low-sulfur and high purification as described above, treatments and processing in Steps 1-5 are effective as described in 3-1. to 3-5 below.

When Al and oxygen are supplied to molten steel, the molten steel temperature is raised and also $Al_2O_3$ is generated. This $Al_2O_3$ floats to the surface of molten steel with increasing molten steel temperature and is absorbed into slag after floating. At this time, the $Al_2O_3$ and slag integrate with each other at high temperature and the absorption of the $Al_2O_3$ into this slag changes the chemical composition of the slag. Further, $Al_2O_3$ is gradually generated with supply of oxygen and sequentially gets surfaced, and thus a change in the chemical composition of the slag is gradual; a rapid composition change of the slag, which takes place in the case where $Al_2O_3$ or synthetic flux is added, does not occur. Furthermore, since $Al_2O_3$ uniformly floats to the entire molten steel surface, it disperses in the entire slag. And this case is different from a local addition as in a batch addition, whereby the slag can be sufficiently stirred and mixed even if the stirring is weak and also the mixing time can be shortened.

Therefore, the slag chemical composition can be controlled by utilizing the $Al_2O_3$ component generated by supply of Al and oxygen to molten steel for the control of a slag chemical composition to attempt to mix the $Al_2O_3$ component at high temperature, to gradually change the composition and to uniformly disperse the $Al_2O_3$ component. The control of the chemical composition of the slag described above makes it possible to avoid strong stirring and also shorten the treatment time, so that other than desulfurization achievement, an increase in the N content in molten steel by nitrogen absorption from air can be suppressed.

3-1. Step 1

In Step 1, the CaO-type flux is added to molten steel at atmospheric pressure to undergo desulfurization. Here, the reason of CaO addition at atmospheric pressure is that since CaO addition under reduced pressure increases refining costs in Step 1 and oxidation refining is carried out in the subsequent step, it is unnecessary to do it under reduced pressure. Though Al is basically supplied to molten steel prior to addition of the CaO-type flux, it may be added at the same time with the addition of the CaO-type flux. Nitrogen absorption from air can be suppressed by slag by addition of Al in the earliest stage of CaO treatment, in addition to the improvement of desulphurization efficiency.

3-2. Step 2

Next, in Step 2, the molten steel and the added flux are stirred by injecting an inert gas into the molten steel in the ladle at atmospheric pressure and also an oxidizing gas is supplied to the molten steel to thereby mix the CaO-type flux with an oxide generated by the reaction of the oxidizing gas with the molten steel. This treatment is to react the Al in the molten steel with oxygen and utilize the generated $Al_2O_3$ component to thereby control the chemical composition of the slag and promote melting of the slag. Here, the reason why an inert gas is injected thereinto is that the absorption of an oxidizing gas into molten steel smoothly proceeds by virtue of the inert gas injection. This is because, when an oxidizing gas only is supplied without injecting an inert gas thereinto, oxidation reaction progresses only in the limited region where the oxidizing gas collides with the molten steel surface, and the homogeneous distribution of $Al_2O_3$ is retarded.

In Step 2, as the control of a slag chemical composition and its melting progress, the effect of inhibiting nitrogen absorption from air is increased by this melting, and the desulfurization reaction proceeds at the same time. However, the desulfurization reaction does not reach the saturated state within the time period for supplying the oxidizing gas mentioned above and a desulfurizing capability surplus remains in the slag. Here, "desulfurizing capability surplus" means desulfurizing ability governed by the chemical composition of slag as described below. In addition, $Al_2O_3$ remains in the molten steel by an amount of tens of ppm as inclusions though it is not large enough to change the chemical composition of the slag.

3-3. Step 3

Thus, after Step 2 above, the supply of an oxidizing gas is halted in Step 3, and desulfurization and removal of inclusions are performed by injecting a stirring gas into the molten steel at atmospheric pressure. By this treatment, further desulfurization with slag having desulfurizing capability surplus and removal of unwanted residual inclusions are attempted. "Desulfurizing capability surplus" here means the sulfide capacity governed by the chemical composition of slag, that is, the "desulfurizing capability". This sulfide capacity lowers if lower grade oxides such as FeO and MnO are present in slag. Therefore, a slag chemical composition should be controlled to decrease the concentration of lower grade oxides to exhibit desulfurizing power to its maximum.

In Step 2 as above, the supply of an oxidizing gas inevitably generates lower grade oxides. On account of this, an inert gas is injected in Step 3 after Step 2 to reduce the concentration of these lower grade oxides, thereby further enabling desulfurization to be promoted. Additionally, slag can be sufficiently melted in Steps 1 and 2, whereby nitrogen absorption from air can be suppressed even if the inert gas is injected and stirring is carried out.

3-4. Step 4

Next, Step 4 is conducted. In Steps 1 to 3 above, molten steel in the ladle is treated at atmospheric pressure. After these treatments, the ladle is transferred to RH vacuum degassing equipment (hereinafter, also noted as "RH equipment" and treatment by RH equipment is also noted as "RH treatment"), and an oxidizing gas is supplied to the molten steel in RH treatment to increase the molten steel temperature. In addition, the molten steel is then circulated in the RH equipment. Treatments in this step can further improve the desulfurization efficiency and cleanliness.

The reason is as follows. That is to say, the temperature can be raised also in Step 2 as above, and its main object is to promote desulfurization by controlling the chemical composition of slag. Because of this, even when the molten steel temperature is too low, the amount of temperature increase of the molten steel by oxygen supply may be limited. For example, when the molten steel temperature before treatment is lower than a specific planned value, the amount of supply of an oxidizing gas needs to be increased to raise the molten steel temperature. However, since the amount of formation of $Al_2O_3$ increases when the oxidizing gas supply amount is increased, the amount of introduction of CaO cannot help being increased. This results in an increase in the amount of slag.

Thus, the following method was adopted in the present invention. In other words, the amount of supply of an oxidizing gas in Step 2 is taken as the amount of supply of oxygen suitable for the control of the chemical composition of slag that is primarily directed to desulfurization. In this case, the molten steel temperature may become slightly low. This temperature shortage should be compensated in any of the stages. As described above, when the temperature is increased using an oxidizing gas, the concentrations of FeO and MnO in the slag are increased, resulfurization from the slag to the molten steel could possibly happen. Accordingly, we paid attention to the fact that almost no reaction between the slag and the molten steel proceeds in the RH treatment.

The reaction between the slag and the molten steel in RH treatment is slow, so that the resulfurization is not easily caused even if the FeO and the MnO contents or the $Al_2O_3$ content is increased in the slag during RH treatment. Therefore, when the molten steel temperature is insufficient in Step 2, the molten steel temperature may be increased by supplying an oxidizing gas in Step 4, RH treatment. This method can improve desulfurization effects in Steps 1 to 3 and further compensate the molten steel temperature without spoiling the desulfurization effects.

In addition, the implementation of RH treatment after each treatment at atmospheric pressure makes it possible to carry out denitrification treatment in the end and further obtain nitrogen-decreasing effect.

Additionally, though the purification effect of molten steel is obtained by treatment of Step 3 above, when cleanliness higher than that obtained by Step 3 is demanded, cleanliness can be improved by further continuing to circulate molten steel in RH equipment after the supply interruption of an oxidizing gas. Besides inclusions partly remaining even after treatment of Step 3, when the molten steel temperature is adjusted by carrying out temperature-raising heating while the desulphurization efficiency is kept high-level in. Step 4, $Al_2O_3$ inclusions may be generated by temperature-raising heating to remain in the molten steel. In such case, to remove these inclusions, the cleanliness of molten steel can be still further improved by performing circulation treatment for a fixed time after supply of an oxidizing gas.

3-5. Step 5

Finally, Ca is added to the molten steel in Step 5. The S and N contents in the molten steel are stable at a low level and the cleanliness is also high by treatments of Steps 1 to 4, whereby the method of producing steel for a steel pipe described in claim 1 or 2 can be stably carried out by addition of Ca in step 5. In this case, the amount of Ca addition is more preferably set in the range that satisfies the relation of equation (3) specified in claim 3.

A rise in temperature of molten steel and control of the chemical composition of slag can be performed simultaneously to increase the cleanliness of the steel as well as to reduce sulfur and nitrogen by carrying out the treatment by Steps 1 to 5 described as above in the order numbered.

3-6. Confirmation of Effectiveness of Invention

The present inventors conducted the following tests and confirmed the effectiveness of the invention according to claim 4. Using 250 tons (t) of molten steel having chemical compositions indicated in Table 1, Tests E1 to E6 are carried out, the outlines of which were shown below.

TABLE 1

| Chemical composition (% by mass) | | | | | | | |
|---|---|---|---|---|---|---|---|
| C | Si | Mn | P | S | Al | N | T. [O] |
| 0.04~0.06 | 0.1~0.3 | 0.5~1.2 | 0.007~0.010 | 0.0028~0.0035 | 0.01~0.03 | 0.0030~0.0045 | 0.0035~0.0055 |

Test E1: Steps 1, 2, 3 and 5 only were carried out.

Test E2: Steps 1, 2, 4 and 5 only were carried out.

Test E3: Steps 2, 3, 4 and 5 were sequentially carried out after Step 2.

Test E4: Steps 1, 2, 3 and 5 were sequentially carried out after Step 4.

Test E5: Steps 4 and 5 only were carried out.

Test E6: It was carried out as in claim 4.

Detailed conditions in each step were set in the following. That is, the amount of CaO to be added in Step 1 was set at 8 kg/(t-molten steel) and added to molten steel immediately after the start of treatment. In Step 2, an Ar gas was injected into molten steel at a flow rate of 0.01 $Nm^3/t$ at atmospheric pressure and at the same time an oxygen gas was sprayed onto the molten steel surface at a feed speed of 0.16 $Nm^3/(min \cdot t)$ for 10 minutes. In Step 3, the flow rate of an Ar gas was set at 0.01 $Nm^3/t$ and stirring treatment was performed for 10 minutes.

In addition, in Step 4, an oxygen gas was sprayed onto the molten steel surface within the RH vacuum chamber for 3 minutes at a feed rate of 0.14 $Nm^3/(min \cdot t)$, and then the molten steel was circulated for 10 minutes. Then, in Step 5, a CaSi alloy was added according to the relation of equation (3) above depending on the N content in the molten steel analyzed in Step 4. Additionally, the amount of Ca addition (WCA) in equation (3) indicates genuine metal Ca to be added (kg/t-molten steel) in terms of the mass per production unit, and therefore the amount of addition of the CaSi alloy was controlled such that the mass of genuine metal Ca in the CaSi alloy satisfied the relation of equation (3).

The results of the S and N contents, cleanliness indexes, minima and maxima [N]/(% CaO) obtained by above Tests were shown in Table 2.

TABLE 2

| Test No. | [S] (ppm) | [N] (ppm) | Cleanliness index | Minimum [N]/(% CaO) | Maximum [N]/(% CaO) |
|---|---|---|---|---|---|
| E1 | 4 | 48 | 1.8 | 0.45 | 1.80 |
| E2 | 3 | 39 | 1.7 | 1.10 | 1.70 |
| E3 | 15 | 51 | 2.1 | 1.20 | 1.70 |
| E4 | 13 | 62 | 1.7 | 0.70 | 1.80 |

TABLE 2-continued

| Test No. | [S] (ppm) | [N] (ppm) | Cleanliness index | Minimum [N]/(% CaO) | Maximum [N]/(% CaO) |
|---|---|---|---|---|---|
| E5 | 25 | 35 | 1.9 | 0.80 | 1.70 |
| E6 | 3 | 38 | 1.0 | 1.30 | 1.50 |

In this Table, the cleanliness index was indicated by setting the number of inclusions in Test E6 to 1.0 as norm. Moreover, the minimum [N]/(% CaO) and the maximum [N]/(% CaO) indicated respectively the minimum value and the maximum value of 25 inclusions for each Test that were examined.

Though, from the results of the Table, various processes are possible according to steps to be adopted and their combinations, it has been ascertained that the variation of the values of N/(% CaO) is the smallest for Test E6 according to the invention described in claim 4. The above results clearly indicated that the method of treating molten steel by processes indicated in Steps 1 to 5 as described in claim 4 is a melting and refining method that can control the inclusions with the highest precision that is intended by the present invention.

BEST MODE FOR CARRYING OUT THE INVENTION

Figure 1:
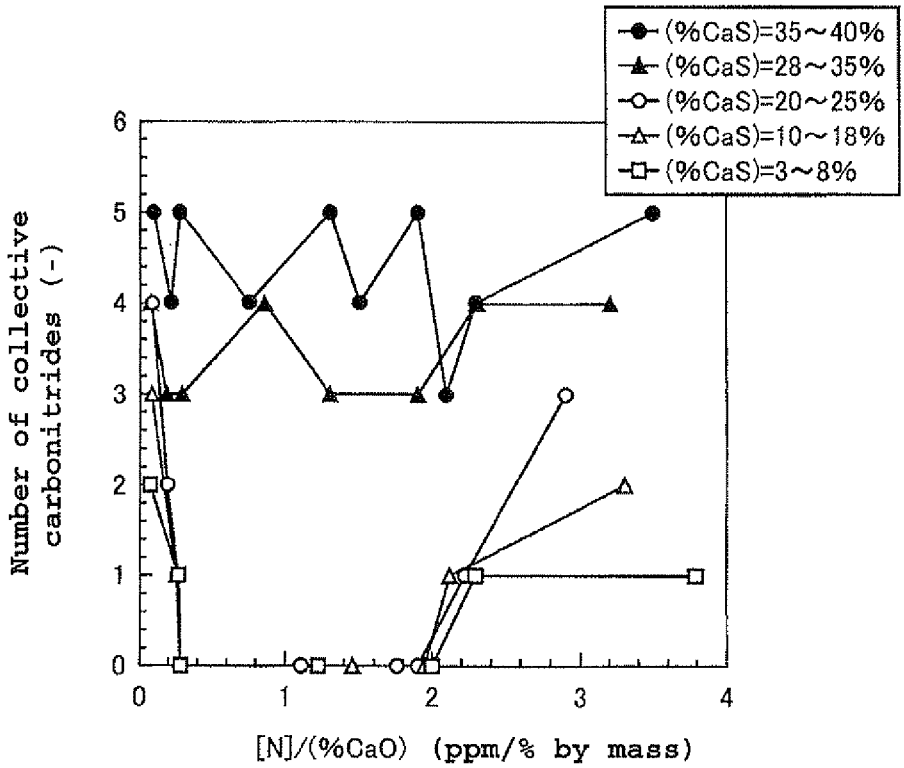
FIG. 1 is a diagram indicating the relationship between [N]/(% CaO) as being the ratio of the N content in steel to the CaO content in inclusions and the number of collective carbonitrides.
Figure 2:
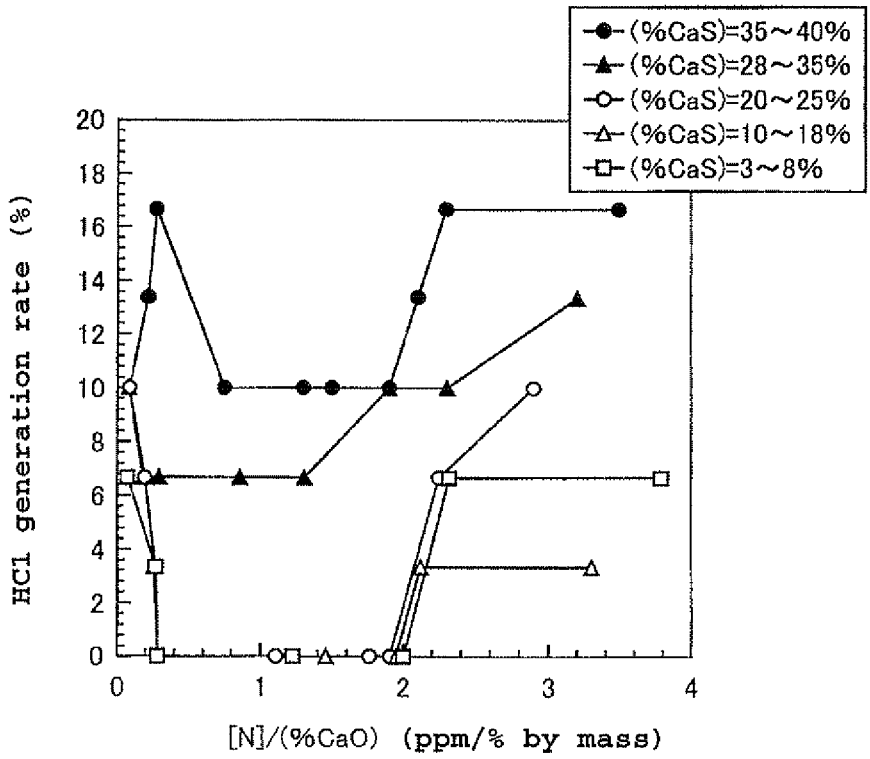
FIG. 2 is a diagram indicating the relationship between [N]/(% CaO) as being the ratio of the N content in steel to the CaO content in inclusions and the generation rate of HIC.
Figure 3:
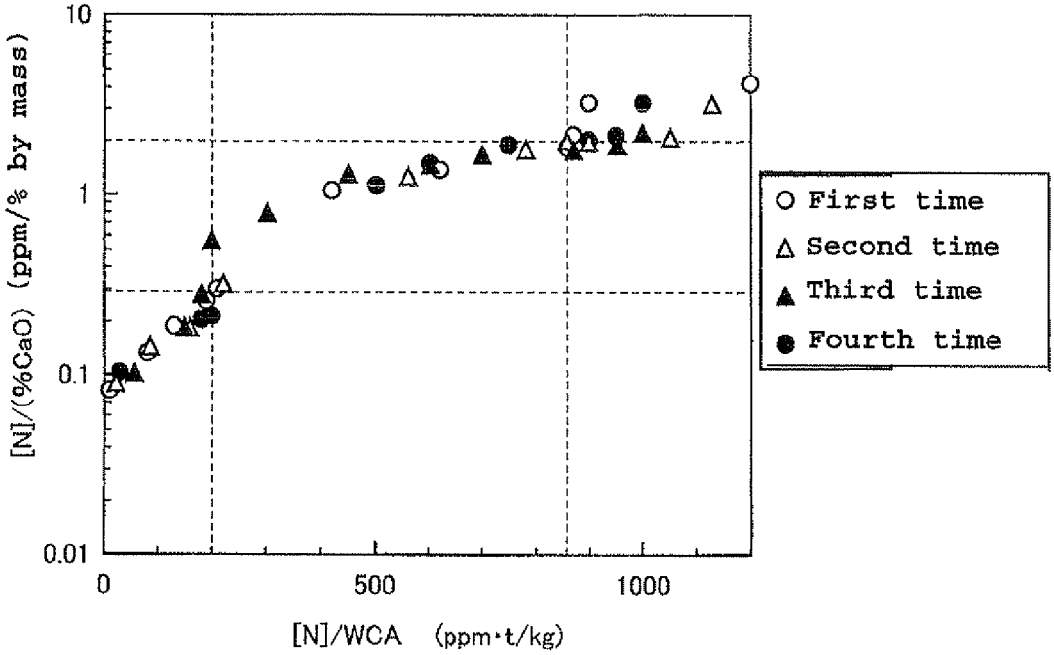
FIG. 3 is a diagram indicating the relationship between [N]/WCA as being the ratio of the N content in steel to the amount of Ca addition and [N]/(% CaO).

The composition other than Ca in steel for a steel pipe of the present invention may be adjusted between before the addition of Ca and after the completion of converter blowing. In particular, they are preferably adjusted before the processes of Steps 1 to 4 described in claim 4 are completed. The reason is that, when the composition is adjusted after the addition of Ca, the treatment time period of molten steel becomes long, and during its time period, the Ca evaporates and thus the Ca content in the steel is unpreferably significantly lowered.

1. Best Mode of Inclusions in Steel

In the present invention, nonmetallic inclusions in steel are Ca—Al—O—S-type inclusions by addition of Ca to the steel composition described in claim 1. The inclusions primarily include CaO—CaS—$Al_2O_3$ and generate carbonitrides including Ti, Nb, etc. on their surfaces. This carbonitrides may be generated either on the surfaces of Ca—Al—O-type inclusions in film form or partially on their surfaces. In addition, the content of the carbonitrides generated on the surfaces is not particularly specified. Moreover, MnS may be generated on the surfaces of the inclusions by composition segregation, and this does not particularly affect HIC.

However, the CaO content in the inclusions needs to be from 30 to 80%. Preferably, the CaO content in the inclusions is from 45 to 60%. This reason is that CaO can be spheroidized more stably than inclusions, while allowing wettability with molten iron to be improved to thereby promote the generation of carbonitrides onto the surfaces of the inclusions.

The CaS content in the inclusions may be 25% or less, preferably 15% or less, more preferably 5% or less. This is because the lower the CaS content, the more the generation of carbonitrides onto the surfaces of the Ca—Al—O—S-type inclusions is facilitated and at the same time the ability of capturing S as segregation element during solidification is promoted.

In addition, when the Al content in steel is 0.008% or less, oxides of Si or Ti may be generated on the surfaces of Ca—Al—O—S-type inclusions; however, this does not particularly affects HIC. However, this leads to the enlargement of inclusions, so that oxides of Si or Ti are preferably totally 15% or less.

2. Best Mode of Ca Addition

In the present invention, the composition of inclusions during a refining step does not need to be identified, it is enough to perform quick analysis prior to the Ca addition to measure the N content in steel and determine the amount of Ca addition based on the measurement result and equation (3) above. Here, WCA in equation (3) is the genuine added metallic Ca per production unit, i.e., the genuine mass of Ca in a Ca-containing agent added to one (1) ton of molten steel (kg/t-molten steel).

For instance, when a CaSi alloy having a Ca content of 35% and a Si content of 65% is added in a proportion of 1 kg/(t-molten steel), WCA is 0.35 kg/(t-molten steel). Incidentally, the addition of metallic Ca is concerned, so that, for example, when a mixture having 50% of Ca and 50% of CaO is added in an amount of 1 kg/(t-molten steel), WCA is 0.5 kg/(t-molten steel).

Here, Ca agents to be added that can be used include, in addition to metallic Ca, alloys such as CaSi and CaAl or mixtures of the above alloys and compounds like CaO, $Al_2O_3$, and the like.

A method of adding can be any one such as an injection method that injects Ca additives into molten steel together with carrier gas, a method of making Ca additives in the form of wire or feeding wireshaving Ca additives embedded inside into molten steel, or the like. However, the addition rate is preferably in the range of 0.01 to 0.1 kg/(min·t-molten steel) in terms of genuine metallic Ca. The reason is that, when the addition rate is less than 0.01 kg/(min·molten steel), the treatment time gets too long, while when the addition rate exceeds 0.1 kg/(min·t-molten steel) and becomes high, splashing and the like becomes violent.

Moreover, the value of WCA as Ca addition amount is preferably made to be in the range of 0.05 to 0.25 kg/t-molten steel). If the value of WCA is less than 0.05 kg/(t-molten steel), the distribution of CaO concentrations in inclusions could be very likely to be in a lower level, while if the value of WCA exceeds 0.25 kg/(t-molten steel) and becomes high, the oxygen activity becomes too low to thereby get nitrogen absorbed to increase the N content in steel remarkably in some cases. A more preferred range of WCA is from 0.1 to 0.2 kg/(t-molten steel).

3. Best Mode of Process of Producing Steel for Steel Pipes

The best mode of the method of the present invention is, as described above, the method of producing steel for a steel pipe excellent in sour-resistance performance described in any one of claims 1 to 3 that is for melting and refining extra-low-sulfur high-cleanliness steel excellent in sour-resistance performance, wherein molten steel is treated by the steps indicated in Steps 1 to 4 below and subsequently adding Ca in Step 5 below. Here, the method includes the following steps: Step 1: CaO-type flux is added to molten steel in a ladle at atmospheric pressure; Step 2: after Step 1 above, the molten steel and the CaO flux are stirred by injecting a stirring gas into the molten steel in the ladle at atmospheric pressure and also an oxidizing gas is supplied to the molten steel to thereby mix the CaO-type flux with oxides generated by reaction of the oxidizing gas with the molten steel; Step 3: the supply of the above oxidizing gas is halted, and desulfurization and the removal of inclusions are carried out by injecting a stirring gas into the molten steel in the ladle at atmospheric pressure; Step 4: an oxidizing gas is supplied into an RH vacuum chamber to increase the molten steel temperature when the above molten steel in the ladle is treated using an RH degasser after Step 3 above, and subsequently the supply of the oxidizing gas is halted, and then the circulation of the molten steel within the RH degasser is continued to remove inclusions in the molten steel; and Step 5: metallic Ca or a Ca alloy is added to the above molten steel in the ladle after Step 4 above.

Hereinafter, a suitable aspect to carry out a melting and refining method according to the present invention will be described in more detail.

3-1. Step 1

3-1-1. Time Period for Addition, Method of Adding and Amount of Addition of CaO-Type Flux In this Step, molten steel is tapped after the completion of converter blowing and a part or the whole of the CaO-type flux used for molten steel desulfurization treatment is added to the upper part of the molten steel accommodated in the ladle. As the amount of Al addition and the amount of an oxidizing gas supply are determined according to a target temperature and a target Al content and a target S content, the amount of CaO-type flux according to them is added. The CaO-type flux in a predetermined amount may be added in a lump sum or in fractional amounts.

Treatment becomes simple and easy in case of adding in a lump sum, while adding in fractional amounts makes it easy to melt and form slag. However, the total addition amounts of CaO-type fluxes in Steps 1 and 2 need to be grasped so that all of them be added by the completion of the supply of an oxidizing gas in Step 2. The reason is that, in utilizing generated $Al_2O_3$ in the present invention, the reaction of the flux with the generated $Al_2O_3$ does not proceed sufficiently if the CaO-type flux were added after the supply of the oxidizing gas, and the promotion of slag melting and forming could possibly become insufficient. In addition, the reason is that since the CaO-type flux has a high melting point, it is preferable to further promote the melting of the CaO-type flux and slag formation making use of the high temperature region that is formed by supplying an oxidizing gas in following Step 2.

Additionally, although the CaO-type flux may be added after the completion of supply of an oxidizing gas in order to, for example, raise the melting point of slag in the ladle, it is an improved technology of the present invention, and the present invention does not exclude such flux addition.

The CaO-type flux means a king of flux in which the CaO content is 45% or more and, for example, the flux made up of single quicklime or principal quicklime and a blend of $Al_2O_3$, MgO, etc. can be used. Moreover, a premelt synthetic slag agent with good slag forming characteristics like calcium aluminate may be used. The slag chemical composition on molten steel should be controlled within a proper range from Step 3 onwards in performing desulfurization and purification to melt and refine an extra-low-sulfur high-cleanliness steel. For that purpose, the CaO-type flux is preferably added in an amount of 6 kg/t or more, more preferably 8 kg/t or more, in terms of converted CaO, by the completion of supply of an oxidizing gas in Step 2.

The method of adding of the CaO-type flux can be any one of (1) injecting its powders into the molten steel via a lance, (2) spraying its powders onto the molten steel surface, (3) placing it on molten steel in the ladle, and (4) further adding it into the ladle at the time of tapping molten steel from the converter, and the like. However, in the inventive method of processing at atmospheric pressure, the method of adding the total amount of CaO-type flux into the ladle at the time of tapping, although facilities dedicated for such as injecting or spraying are not used, is simple and easy and suitable.

It is preferred that the chemical composition of molten steel in the ladle before the addition of the CaO-type flux is set to be C, 0.03 to 0.2%, Si: 0.001 to 1.0%, Mn: 0.05 to 2.5%, P: 0.003 to 0.05%, S: 11 to 60 ppm, and Al: 0.005 to 2.0%, and the temperature is set to about 1580 to about 1700° C. However, the adjustment of these elements of molten steel may be carried out after the addition of CaO and before the supply of an oxidizing gas.

3-1-2. Method of Adding and Amount of Addition, etc. for Al

By the addition of Al, a heat source for molten steel heating-up in the following Steps and $Al_2O_3$ source are supplied. Al reduces oxygen in molten steel and iron oxide in slag and finally becomes $Al_2O_3$ in the slag. Al lowers the melting point of the slag, and effectively functions for the desulfurization and purification of the molten steel.

The slag chemical composition on molten steel should be controlled within a proper range after Step 3 to achieve desulfurization and purification to melt and refine extra-low-sulfur high-cleanliness steel. Al, totaled from Step 1 to Step 2, by the completion of supply of an oxidizing gas, is preferably added in an amount of 1.5 kg/t or more, more preferably 2 kg/t or more, in terms of metallic Al equivalent. This is because, if the amount of addition of Al is less than 1.5 kg/t, the amount of $Al_2O_3$ generated is too small, and the amount of addition of CaO needs to be adjusted while the effect of using Al for slag control becomes small. In addition, the effect of sufficiently decreasing lower grade oxides in the slag also becomes small, so that variation in the effect becomes slightly large.

The method of adding Al, like the method of adding the CaO-type flux, can use any of (1) a method of injecting the powders into the molten steel via a lance, (2) a method of spraying the powders onto the molten steel surface, (3) a method of placing the powders on molten steel in the ladle, and further (4) a method of adding Al into the ladle at the time of tapping molten steel from the converter, and the like. Additionally, as an Al source, either pure metallic Al or an Al alloy may be used, or the residue or the like at the time of Al smelting can also be used.

Moreover, when molten steel subjected to converter blowing is tapped to a ladle, the inflow of a converter slag to the ladle is preferably suppressed. This is because the converter slag contains $P_2O_5$ and not only causes the P content in molten steel to rise in a subsequent desulfurization treatment step, but makes it difficult to control the slag chemical composition when the amount of inflow slag to the ladle varies. To that end, it is preferred to decrease the outflow of a slag from the converter to suppress the inflow of a slag into the ladle by means of, for example, decreasing the formation of a converter slag, introducing a blade-shaped dart to immediately above a molten steel tapping port during converter tapping to suppress the formation of vortexes of molten steel in the upper part of the molten steel tapping port, and further detecting the outflow of a slag from the converter by an electrical, optical or mechanical method to halt the molten steel tapping flow in accordance with the timing of the slag outflow.

Not only Step 1 but also either Step 2 or Step 3 described below is also carried out at atmospheric pressure. The reason is that besides the fact that strong stirring operation under reduced pressure does not need to be performed in the present invention, facility and running costs are increased when the processes of Steps 1 to 3 are performed under reduced pressure.

3-2. Step 2

In Step 2, the molten steel and the CaO-type flux are stirred by injecting a stirring gas into the molten steel in the ladle at atmospheric pressure to which the CaO-type flux is added in Step 1, and also an oxidizing gas is supplied to the molten steel to thereby mix the CaO-type flux with oxides such as $Al_2O_3$ generated by reaction of the oxidizing gas with the molten steel.

As described above, a part of or the whole of CaO-type flux may be added in Step 2, or a part of or the whole of Al may be added in Step 2. However, the amount of addition of CaO and Al directly concerned in the present invention means the amount including not only the one put in the ladle before the start of the molten steel tapping from the convertor but also those used from the start of molten steel tapping until the completion of supply of an oxidizing gas in Step 2.

3-2-1. Method of Supplying Oxidizing Gas

The reason why an oxidizing gas is supplied to molten steel in Step 2 is that the heat up of the molten steel or the suppression of a temperature decrease is to be promoted by making use of oxidation exothermic reaction caused by reaction of molten steel chemical elements with an oxidizing gas, and also $Al_2O_3$ is to be generated to control the chemical composition of a slag. The above kind of gases that have capability to oxidize chemical elements in molten steel can be used as this oxidizing gas.

The methods of supplying an oxidizing gas that can be used include (1) a method of injecting an oxidizing gas into molten steel, (2) a method of spraying an oxidizing gas from a lance or a nozzle placed above molten steel, and the like. Among all, the method of spraying the gas to the surface of molten steel using a top lance is preferred, from the viewpoints of slag melting and improvements of slag formation by utilization of the controllability of a slag chemical composition and a high temperature region. The preferred method can directly heat the CaO-type flux to promote the formation of slag of the CaO-type flux by making use of the high temperature region formed by reaction of an oxidizing gas with molten steel in the ladle.

When an oxidizing gas is sprayed to molten steel from a lance or a nozzle placed above the molten steel, the intensity of spraying the oxidizing gas should be secured to some extent to effectively transmit generated heat to slag. The height of the lance should be lowered to approach the molten steel in order to secure this spraying intensity. As a result, the lance life span decreases due to radiant heat received from the molten steel to increase the replacing work of the lance, so that it is difficult to maintain high productivity. Therefore, when an oxidizing gas is sprayed to molten steel through a lance or a nozzle, the lance or the nozzle is preferably made to be a water-cooled structure.

The height from the molten steel surface to the lance or nozzle (i.e., the vertical distance from the molten steel surface to the lance lower end) is preferably set in the range of about 0.5 to about 3 m. This is because, if the height of the lance or nozzle is less than 0.5 m, the spitting of the molten steel gets active and also the life span of the lance or nozzle could be possibly shortened, while if the height exceeds 3 m and becomes large, the oxidizing gas jet scarcely reaches the molten steel surface, whereby the oxygen efficiency in refining could be possibly extremely lowered.

3-2-2. Amount of Supply, etc. of Oxidizing Gas

The amount of supply of an oxidizing gas in Step 2 is preferably 0.4 $Nm^3/t$ or more, more preferably 1.2 $Nm^3/t$ or more, in pure oxygen equivalent. This amount of supply of oxygen is the one that is preferred to obtain a heat source for maintaining and increasing the temperature of molten steel by oxidizing Al, and also the one that is preferred for also promoting slag forming of a CaO source added in Step 1. Adjusting the amount of supply of oxygen to the above amount generates an amount of $Al_2O_3$ suitable for slag formation and makes the controllability of the slag chemical composition better and further improves the desulfurization and purification function of the molten steel.

In addition, the feed rate of an oxidizing gas is preferably made in the range of 0.075 to 0.24 $Nm^3/(min \cdot t)$ in pure oxygen equivalent. If the feed rate of an oxidizing gas is less than 0.075 $Nm^3/(min \cdot t)$, the treatment time becomes long, which could possibly lower the productivity. On the other hand, if the feed rate exceeds 0.24 $Nm^3/(min \cdot t)$ and becomes high, even though the CaO-type flux can be sufficiently heated, the feed time of an oxidizing gas becomes short and at the same time the amount of generation of $Al_2O_3$ per unit time is increased too much, so that a sufficient time for homogenizing the melting of slag and the chemical composition of slag could not be secured. Moreover, the life span of a lance and a ladle refractory could be lowered. Additionally, the feed rate of an oxidizing gas is more preferably set at 0.1 $Nm^3/(min \cdot t)$ or more from the viewpoint of securing productivity.

In Step 2, the supply of an oxidizing gas that is performed as described above causes $Al_2O_3$ to be generated and also the molten steel temperature to increase. In addition, the slag melting and slag formation are promoted by making use of the high temperature region present at the firing point. Additionally, $Al_2O_3$ generated by reaction of an oxidizing gas with molten steel is mixed with the CaO-type flux by injecting a stirring gas from a lance immersed in the molten steel to thereby control the chemical composition of the slag.

The oxides generated by reaction of an oxidizing gas with molten steel include $Al_2O_3$ primarily and concurrently small amounts of FeO and MnO, and even $SiO_2$ are also generated. Either of these oxides causes the melting point of CaO to be decreased. These oxides exhibit the function of decreasing the melting point of slag by mixing with CaO, and thus promote the slag formation of the CaO-type flux. Here, FeO and MnO of these oxides have the function of increasing the oxygen potential of slag, and thus thermodynamically disadvantageously act on the desulfurization of molten steel, and finally react with Al in the molten steel due to gas stirring in the subsequent Step 3 to thereby disappear.

3-2-3. Method of Injecting Stirring Gas and Amount of Injection

The methods of stirring in Step 2 include (1) a method of introducing a stirring gas into molten steel through a lance immersed in the molten steel, (2) a method of introducing a stirring gas from a porous plug placed on the bottom of a ladle, and the like. Amongst, it is preferred to introduce a stirring gas into molten steel through a lance immersed in the molten steel. The reason is that, for a method of introducing a stirring gas from a porous plug placed on the bottom of a ladle and the like, the introduction of gas at a sufficient flow rate is difficult and thus mixing of slag with $Al_2O_3$ becomes insufficient; as a result, the melting and refining of extra-low-sulfur steel may become difficult.

The flow rate of injection of a stirring gas is preferably made in the range of 0.0035 to 0.02 $Nm^3/(min \cdot t)$. This is because, if the flow rate of injection is less than 0.0035 $Nm^3/(min \cdot t)$, the stirring power comes up short and thus the stirring of slag and $Al_2O_3$ becomes insufficient and also the oxygen potential of the slag is increased, whereby a decrease in oxygen potential of the slag in Step 3 that is a subsequent Step becomes insufficient, which could possibly be disadvantageous in desulfurization. On the other hand, if the flow rate of injection exceeds 0.02 $Nm^3/(min \cdot t)$ and becomes large, the generation of splash becomes extremely large, which could lower the productivity. The flow rate of injection is more preferably set to be 0.015 $Nm^3/(min \cdot t)$ or less in order to lower the oxygen potential of the above slag as much as possible and to avoid a decrease in productivity.

3-3. Step 3

Step 3 involves halting the supply of an oxidizing gas by use of a top lance or the like, and also performing desulfurization and removing inclusions by continuing the stirring of molten steel and slag by means of the injection of a stirring gas via the lance immersed in the molten steel in the ladle or the like at atmospheric pressure.

3-3-1. Method of Injecting Stirring Gas and Amount of Injection

The injection time of the stirring gas after the halt of supply of an oxidizing gas is preferably set to be 4 minutes or more, more preferably 20 minutes or less. In addition, the amount of injection of a stirring gas is preferably set in the range of 0.0035 to 0.02 $Nm^3/(min \cdot t)$. The reason why the continuation of stirring under the above conditions is preferred in melting and refining extra-low-sulfur high-cleanliness steel will be described in the following.

In Step 2, it is considered that the feed rate of an oxidizing gas is decreased or an oxidizing gas is supplied while injecting a large amount of a stirring gas into molten steel at atmospheric pressure in order not to increase the oxygen potential of slag at the time of supply of the oxidizing gas.

However, when the feed rate of an oxidizing gas is extremely lowered, the rate of temperature rise of molten steel is decreased, thereby lowering the productivity. Additionally, when an extremely large amount of stirring gas is injected into molten steel at atmospheric pressure, the spattering/splashing of the molten iron increases, leading to a cost increase due to a decrease in iron yield and/or a decrease in productivity attributable to the adhesion of spattered/splashed bulk metal to peripheral equipments, or the like.

In the inventive method, with a view to preventing an increase in the oxygen potential of slag due to the feed of an oxidizing gas without causing the above-mentioned problems, the stirring of molten steel and slag in the ladle is separately performed in the supply period of an oxidizing gas (Step 2) and in a subsequent period without supply of an oxidizing gas (Step 3). In other words, even after the supply of an oxidizing gas by a top lance or the like is halted, the injection of a stirring gas into the molten steel is continued through a lance immersed in the molten steel in the ladle, or the like. The concentration of lower grade oxides in the slag is lowered by implementing this Step, and the desulfurization ability of the slag can be exhibited to the maximum. In addition, under usual gas supply conditions, the ratio ($t/t_0$) of the stirring gas injection time t in Step 3 to the oxidizing gas supply time $t_0$ in Step 2 is preferably set to be 0.5 or more.

In Step 3, both desulfurization and separation of oxide-type inclusions generated by supplying an oxidizing gas in Step 2 are carried out at the same time. The gas stirring time by stirring gas injection is preferably made to be 4 minutes or more. This is because, if the gas stirring time is less than 4 minutes, it is difficult to sufficiently lower the oxygen potential of slag in Step 3 that is increased by the supply of an oxidizing gas in Step 2 and also it is difficult to secure the reaction time for improving the desulfurization efficiency and for sufficiently lowering the total oxygen content (T. [O]). The longer the gas stirring time, the more the low sulfur treatment and purification function are improved. However, on the other hand, the productivity decreases and the molten steel temperature also decreases, and thus the stirring time is actually preferably set to be about 20 minutes or less.

The injection of a stirring gas carried out in Step 3 is also preferably performed by the method of introducing a stirring gas through a lance immersed in molten steel. The reason is that, for example, when a stirring gas is introduced from a porous plug placed on the bottom of a ladle, the gas with a sufficient flow rate is difficult to be introduced into molten steel, and therefore FeO and MnO components in slag in Step 3 cannot be sufficiently reduced, which sometimes makes it difficult to melt and refine extra-low-sulfur steel.

The inventive method includes gas stirring treatment at atmospheric pressure as part of its features. This is because it is difficult to intensively stir the slag and metal in a small amount of gas injection like gas stirring under reduced pressure and also to perform gas stirring under stable gas flow conditions.

The flow rate of injection of a stirring gas is preferably set to be 0.0035 to 0.02 $Nm^3/(min \cdot t)$ as described above. This is because, if the flow rate of injection is less than 0.0035 $Nm^3/(min \cdot t)$, the stirring power comes up short and thus the reduction of the oxygen potential of slag in Step 3 becomes insufficient, so that further desulfurization could not possibly be promoted. In addition, if the flow rate of injection exceeds 0.02 $Nm^3/(min \cdot t)$ and becomes large, the generation of splash becomes extremely active, which could lower the productivity. The flow rate of injection is more preferably set to be 0.015 $Nm^3/(min \cdot t)$ or less in order to lower the oxygen potential of slag as much as possible and to avoid a decrease in productivity.

3-3-2. Slag Chemical Composition after Completion of Step 3

For the slag chemical composition after the completion of treatment by Step 3, preferably, the mass content ratio of CaO to $Al_2O_3$ (hereinafter, also noted as "$CaO/Al_2O_3$") is set at 0.9 to 2.5, the total mass contents of FeO and MnO in this slag (hereinafter, also noted as "FeO+MnO") is set at 8% or less. Further, the slag chemical composition is preferably adjusted to have CaO in the range of 45 to 60%, $Al_2O_3$ in the range of 33 to 46%, $CaO/Al_2O_3 \geqq 1.3$, and $(FeO+MnO) \leqq 4\%$. Explicitly, it is much more preferable to have CaO in the range of 50 to 60%, $Al_2O_3$ in the range of 33 to 40%, $CaO/Al_2O_3 \geqq 1.5$, and (FeO+MnO) 1%. As a result, the control accuracy of the inclusions chemical composition in addition to the improvement of cleanliness is further stabilized.

3-3-3. Steel Chemical Composition and Inclusions Control, etc. after Completion of Step 3

As a result of completion of treatment of Step 3, extra-low-sulfur high-cleanliness steel as having an S content of 10 ppm or less and a T. [O] of 30 ppm or less in molten steel is produced. The temperature at the completion of Step 3 is about 1590 to about 1665° C.

Additionally, as described above, in Steps 1 to 3, treatments are preferably proceeded without immersing a dip tube such as a snorkel in the molten steel in the ladle from the viewpoint of securing an amount of slag that effectively acts on desulfurization. This is because, when the dip tube or the like of degasser is immersed, it partitions the slag to the one inside and the other outside thereof, and while the slag effecting of the slag in the region where an oxidizing gas is supplied is promoted, the slag effecting of the slag present in the other region is delayed and the stirring of the slag present outside the dip tube becomes insufficient, whereby the amount of slag that effectively acts on desulfurization could be decreased.

Here, the amount of slag after the completion of Step 3 is preferably about 13 to about 32 kg/t. If the amount of slag is less than 13 kg/t, it is too small, so that stable desulfurization efficiency is hardly obtainable. Moreover, if the amount of slag exceeds 32 kg/t and becomes large, a time period required to control the slag chemical composition becomes long; as a result, the treatment time may be prolonged.

Implementing the processes of Steps 1 to 3 as described above makes it possible to achieve desulfurization and purification of steel leading up to the extra-low-sulfur region by use of the CaO-type flux and to inexpensively melt and refine extra-low-sulfur high-cleanliness steel having an S content of 10 ppm or less and a T. [O] of 30 ppm or less. In addition, even if fluorite ($CaF_2$) is not added to molten steel in the ladle, the desulfurization and the cleaning action of steel can be secured, so that no use of fluorite is preferred. Fluorite is recently scarcely available due to resource depletion, and also it is becoming less often to use it in consideration of environmental problems, whereby the inventive method that does not require the use of fluorite is suitable as a method of melting and refining environmentally-friendly steel.

In the melting and refining method of the present invention that makes refining reaction proceed by supplying an oxidizing gas to molten steel, the oxidation reaction of molten steel accompanies spattering of splash, smoking and dust emission, whereby it is preferred that a cover is disposed above the ladle to prevent the escape and also they are processed by a dust collector. In addition, the introduction of air can be prevented by controlling the pressure within the above cover to be a positive pressure to thereby be able to prevent the reoxidation of molten steel and the ingress of nitrogen. Moreover, a non-consumable top lance is generally used for the supply of an oxidizing gas and a water-cooled lance is preferably used to improve its cooling efficiency.

3-4. Step 4

Step 4 is the step for compensating temperature while maintaining the state of the extra low S content by suppressing "resulfurization" and for further improving cleanliness. For this, RH equipment should be used. RH treatment involves immersing two dip tubes provided on the bottom of a vacuum tank in molten steel in the ladle and circulating the molten steel in the ladle through these dip tubes and thus is capable of separation treatment of inclusions in a state in which the stirring of slag is weak and the detaining of the slag is little, thereby being able to further conduct higher purification. In addition, since the reaction rate between slag and molten steel is small, the resulfurization can be suppressed even if temperature-raising heating is applied using RH equipment.

A method of performing temperature-raising heating of molten steel that uses RH equipment will be described. An oxidizing gas is injected into molten steel in a vacuum tank while circulating the molten steel between the vacuum tank and the ladle by use of RH equipment, or an oxidizing gas is sprayed onto molten steel in a vacuum tank via a top lance provided in the vacuum tank. Oxygen in this oxidizing gas reacts with Al in the molten steel to generate $Al_2O_3$ and at the same time generates heat of reaction and then the molten steel temperature rises by this heat of reaction. Additionally, the reaction of this Al with oxygen generates $Al_2O_3$ inclusions, FeO and MnO. Generated $Al_2O_3$, FeO, and MnO move into the slag on the surface of the molten steel in the ladle, increasing the (FeO+MnO) content in the slag and lowering the desulfurization ability of the slag.

On this occasion, if the reaction rate of the slag and molten steel should be fast, a resulfurization phenomenon may occur in which S in the slag moves into the molten steel; however, the reaction rate of the slag and molten steel is slow in RH treatment, and hence the resulfurization can be suppressed. Therefore, shifting part of the process of temperature-raising heating to the RH treatment from the desulfurization treatment enables the resulfurization to be suppressed and the temperature to be raised while maintaining the S content in the molten steel at a very low level.

Moreover, when more advanced purification than that at the time of completion of Step 3 is required, inclusions can be further removed and cleanliness can be further improved by continuing to circulate after halting the supply of an oxidizing gas. The RH circulation treatment time after the halt of supply of an oxidizing gas in Step 4 is preferably 8 minutes or more, more preferably 10 minutes or more, still more preferably 15 minutes or more. This RH circulation treatment time may be properly determined according to a required inclusions amount level or hydrogen content level. The T. [O] content after RH circulation treatment is preferably 25 ppm or less, more preferably 18 ppm or less. In addition, the N content after RH treatment is preferably 50 ppm or less, more preferably 40 ppm or less. This is because, as a result, the reduction of the amount of Ca addition and the stabilization of the inclusions composition control can be implemented. Additionally, the supply amount of an oxidizing gas may be properly determined according to a molten steel aimed temperature upon raising temperature.

The feed rate of an oxidizing gas in Step 4 is preferably 0.08 to 0.20 $Nm^3/(min \cdot t)$ in pure oxygen equivalent. If the feed rate of an oxidizing gas is less than 0.08 $Nm^3/(min \cdot t)$, the treatment time of molten steel is extended; if it exceeds 0.20 $Nm^3/(min \cdot t)$ and becomes high, the amounts of generated FeO and MnO unpreferably increase.

The oxidizing gases that can be used include single gases such as oxygen gas and carbon dioxide, mixed gases of said single gases, and blended gases the above gases and inert gases or nitrogen gas. Oxygen gas is preferably used from the viewpoint of shortening the treatment time.

The method of supplying an oxidizing gas can be any of those such as injecting the gas into molten steel and spraying the gas onto the surface of molten steel in a vacuum tank through a top lance. The method of spraying is preferred in consideration of good operability. In this case, the top lance nozzles may include any shapes such as a straight type, a steeply radially expanded type and a Laval type. In addition, the lance height (i.e., the vertical distance between the lance lower end and the surface of molten steel in the vacuum tank) is preferably from 1.5 to 5.0 m. This is because, if the lance height is less than 1.5 m, the lance is very likely to be damaged due to spitting of molten steel, and if the height exceeds 5.0 m and becomes large, the oxidizing gas jet scarcely reaches the molten steel surface, lowering the heating-up efficiency.

The ambient pressure in the vacuum tank during supply of an oxidizing gas is preferably made to be 8000 to 1100 Pa. When the circulation is performed continuously after the halt of supply of an oxidizing gas, the ambient pressure is preferably 8000 Pa or less, more suitably 700 Pa or less. If the ambient pressure in the vacuum tank exceeds 8000 Pa and becomes high, the removal of inclusions unpreferably requires long time due to a slow circulation rate. Additionally, at 700 Pa or less, the H concentration and the N concentration in molten steel can be reduced at the same time, while allowing the removal of inclusions to be effectively carried out.

Moreover, the composition such as Si, Mn, Cr, Ni and Ti in molten steel may be adjusted by addition of alloying elements or the like into the molten steel during or after the supply of an oxidizing gas.

3-5. Step 5

Step 5 is the step of adding metallic Ca or a Ca alloy to molten steel in the ladle after Step 4. Suitable conditions of Ca addition are as described above. The timing of Ca addition may be better to be after Step 4, and the circulation time in Step 4 is preferably 10 minutes or more, more preferably 15 minutes or more. On the other hand, the longer the circulation time, the more the amount of inclusions is reduced; if the circulation time exceeds 30 minutes and becomes long, the effect should be saturated and at the same time the molten steel temperature may be excessively lowered, which is not preferable.

Here, the method of adding Ca and the addition conditions in Step 5 are the same as the case of the method described in the best mode of the invention pertinent to claim 3. In addition, for the purpose of decreasing Ca loss by Ca evaporation, though Ca is preferably added at atmospheric pressure, it may be added in the RH in the ending time period of RH treatment, preferably 3 minutes before and to the end of the RH treatment. In this case, though the total treatment time can be shortened, the loss of Ca is increased if the vacuum treatment is continued for a long time after the addition of Ca in the RH. Because of this, Ca is preferably added 3 minutes before and to the end of the RH treatment.

Additionally, when Ca is added in the RH, the ambient pressure in the vacuum tank is preferably from 6 kPa to 13 kPa, both inclusive. This is because, if the ambient pressure is less than 6 kPa, the evaporation of Ca is activated, while if the ambient pressure exceeds 13 kPa and becomes high, the circulation rate of molten steel decreases, whereby the melding of molten steel becomes insufficient.

Ca may be added after the treatment in Step 4, or in the ending time period of the RH treatment, preferably, 3 minutes before and to the end of the RH treatment, or after the atmosphere surrounding the ladle is established to be atmospheric pressure conditions. Ca is preferably added at atmospheric pressure for the purpose of reducing the loss of Ca due to its evaporation.

Moreover, when Ca is added at atmospheric pressure, the addition of Ca may be carried out after conveying the ladle from the RH equipment to the different location, or may be done in a tundish during casting. In addition, the addition of Ca may be carried out in ambient atmosphere (in air), or under conditions in which the atmosphere gas is substituted by an inert gas such as Ar gas.

Example

Melting and refining tests on steel for a steel pipe shown in the following were carried out and the results were evaluated to confirm the effect of the method of melting and refining extra-low-sulfur high-cleanliness steel according to the present invention.

1. Melting and Refining Test Method

A molten pig iron subjected, as required, to hot metal desulfurization and hot metal dephosphorization treatment in advance was charged to a top and bottom blown converter of a scale of 250-ton (t). Rough decarburization blowing was performed until the C content in the molten pig iron became from 0.03 to 0.2%. The end-point temperature was set to be in the range of 1630 to 1690° C. and the rough decarburized molten steel was tapped to a ladle. At molten steel tapping, a variety of deoxidizing agents and alloys were added thereto to set the molten steel composition in the ladle to be C, 0.03 to 0.35%, Si: 0.01 to 1.0%, Mn: 0.1 to 2%, P: 0.005 to 0.013%, S: 27 to 28 ppm, sol. Al: 0.005 to 0.1%, and T. [O]: 50 to 150 ppm.

1-1. Method of Testing Inventive Example

Steel for a steel pipe was manufactured according to the production method described in claim 4. As Step 1, at the time of molten steel tapping at atmospheric pressure, 8 kg/t of quicklime was added in a lump sum to molten steel in a ladle. In addition, metallic Al of 400 kg was added in a lump sum during this molten steel tapping.

In Step 2, an immersion lance was immersed in the molten steel in the ladle, Ar gas was injected at a feed rate of 0.012 $Nm^3/(min \cdot t)$ and also oxygen gas was sprayed from a top lance with a water-cooled structure onto the surface of the molten steel at a feed rate of 0.15 $Nm^3/(min \cdot t)$. At this time, the vertical distance between the lance lower end and the surface of the molten steel was set to be 1.8 m, and the oxygen feed time was set to be 6 minutes. In addition, a dip tube was not immersed in the molten steel, a cover was placed above the ladle, and evolved gas, splash, dust, etc. were led to a dust collector and processed.

In Step 3, after the supply of the oxygen gas was halted, Ar gas was injected for 10 minutes at a feed rate of 0.012 $Nm^3/(min \cdot t)$ for stirring purpose. The slag chemical composition after the completion of Step 3 has 0.7 to 1.2 of $CaO/Al_2O_3$ and a content of (FeO MnO) of 8 to 22%.

As Step 4, oxygen gas was sprayed at 1.5 $Nm^3/t$ from a top lance placed within a vacuum tank immediately after the start of RH treatment. The lance nozzle used a straight type, the vertical distance between the lance lower end and the surface of molten steel in the vacuum tank was set at 2.5 m, and the feed rate of oxygen gas was set at 0.15 $Nm^3/(min \cdot t)$. The dip tube diameter of RH equipment is 0.66 m, the flow rate of a circulating Ar gas is 2.0 $Nm^3/min$, and the attained vacuum is 140 Pa. After the halt of supply of oxygen gas, the circulation treatment was applied for 15 minutes to complete the treatment. Additionally, the amount of slag in the melting and refining test is about 18 kg/t. A sample was collected from molten steel during treatment of Step 4 and the N content in the molten steel was analyzed. Moreover, an alloy and the like were optionally charged into the molten steel, and the final component was adjusted.

As Step 5, the ladle was transferred to another treatment position other than where the RH equipment is located and Ca was added at atmospheric pressure according to the method described in claim 3. Ca was added by a method of adding wires that have an embedded CaSi alloy with genuine Ca of 30%. The addition rate was set at 0.05 kg/(min·t) in terms of genuine Ca. The amount of Ca addition was determined using the N content analyzed in the RH treatment on the basis of the relation of equation (3) above.

1-2. Method of Testing Comparative Example

Molten steel was melted and refined by the method described below by performing the treatments of Steps 1, 3 and 5 described in claim 4.

In other words, at molten steel tapping at atmospheric pressure, 8 kg/t of quicklime was added in a lump sum to molten steel in a ladle. In addition, metallic Al of 400 kg was added in a lump sum during this molten steel tapping. Next, an immersion lance was immersed in molten steel in the ladle, and the treatment in which Ar gas was injected at a feed rate of 0.012 $Nm^3/(min \cdot t)$ was carried out for 15 minutes. Thereafter, the ladle was transported to RH equipment, and circulation treatment was performed for 10 minutes. During the RH treatment, an alloy and the like were optionally charged into the molten steel, and the final composition was adjusted.

After the RH treatment, the ladle was transported to another treatment position other than the RH equipment, and in that treatment position, Ca was added at atmospheric pressure. Ca was added by a method of adding wires that have the embedded CaSi alloy with genuine Ca of 30%. The addition rate was set at 0.05 kg/(min·t) in terms of genuine Ca.

2. Melting and Refining Test Result

The molten steel melted and refined by the method described in 1-1. and 1-2. above was cast by a continuous casting machine to produce a slab.

The major composition of the molten steel was adjusted to be C, 0.04 to 0.06%, Mn: 0.9 to 1.1%, Si: 0.1 to 0.3%, P: 0.0007 to 0.013%, S: 4 to 8 ppm, Cr: 0.4 to 0.6%, Ni: 0.1 to 0.3%, Nb: 0.02 to 0.04%, Ti: 0.008 to 0.012%, and V: 0.04 to 0.06%.

Next, the obtained slab was heated to 1050 to 1200° C. and then was rolled to a steel plate with a thickness of 15 to 20 mm by hot rolling. This steel plate was formed to a UO line pipe by seam welding process. In addition, this pipe was adjusted to X80 grade of API Standards. Test pieces were cut out of this pipe and their HIC resistance performances were evaluated according to the method stipulated in NACE TM0284-2003. That is to say, 10 test pieces with a size of 10 mm in thickness, 20 mm in width and 100 mm in length were collected from each of the above steel plates and these were immersed in an aqueous solution (0.5% acetic acid+5% salt) for 96 hours at 25° C. saturated with hydrogen sulfide at $1.013\times10^5$ Pa (1 atm). The area of HIC generated in each test piece after testing was measured by ultrasonic flaw detection, and then the crack area ratio (CAR) was determined by equation (4) below. Here, the area of the test piece in equation (4) was set to be 20 mm×100 mm.

$$\text{Crack area ratio (CAR)}=(\text{total value of area of HIC generated in test piece/tested area of test piece})\times 100(\%) \quad (4)$$

Moreover, the composition of the non-metallic inclusions in the steel was quantified using a scanning electron microscope.

Table 3 showed applied treatments in each Step, N contents in steel, CaO contents in inclusions, CaS contents in inclusions, amounts of Ca addition, values of [N]/(% CaO) and [N]/WCA, conformance to equations (1) to (3), and crack area ratios.

TABLE 3

| Classification | Test No. | Step 1 | Step 2 | Step 3 | Step 4 | Step 5 | [N] in steel (ppm) | (% CaO) in inclusions (% by mass) | (% CaS) in inclusions (% by mass) | Amount of Ca addition WCA (kg/t) |
|---|---|---|---|---|---|---|---|---|---|---|
| Inventive Example | 1 | ○ | ○ | ○ | ○ | ○ | 35 | 30 | 8.5 | 0.05 |
| | 2 | ○ | ○ | ○ | ○ | ○ | 42 | 45 | 3.2 | 0.05 |
| | 3 | ○ | ○ | ○ | ○ | ○ | 48 | 52 | 13.5 | 0.06 |
| | 4 | ○ | ○ | ○ | ○ | ○ | 54 | 30 | 14.2 | 0.07 |
| | 5 | ○ | ○ | ○ | ○ | ○ | 45 | 45 | 3.8 | 0.06 |
| | 6 | ○ | ○ | ○ | ○ | ○ | 48 | 68 | 22.5 | 0.22 |
| | 7 | ○ | ○ | ○ | ○ | ○ | 38 | 62 | 9.5 | 0.15 |
| | 8 | ○ | x | ○ | x | ○ | 41 | 70 | 20.5 | 0.15 |
| | 9 | ○ | x | ○ | x | ○ | 42 | 70 | 24.3 | 0.20 |
| | 10 | ○ | x | ○ | x | ○ | 66 | 34 | 5.7 | 0.10 |
| | 11 | ○ | x | ○ | x | ○ | 23 | 70 | 18.3 | 0.11 |
| | 12 | ○ | x | ○ | x | ○ | 65 | 34 | 15.3 | 0.12 |
| | 13 | ○ | x | ○ | x | ○ | 39 | 30 | 8.5 | 0.04 |
| | 14 | ○ | x | ○ | x | ○ | 44 | 35 | 11.3 | 0.05 |
| | 15 | ○ | x | ○ | x | ○ | 41 | 65 | 18.5 | 0.21 |
| Comparative Example | 16 | ○ | x | ○ | x | ○ | 38 | 18 | 15.3 | 0.04 |
| | 17 | ○ | x | ○ | x | ○ | 45 | 21 | 8.5 | 0.05 |
| | 18 | ○ | x | ○ | x | ○ | 47 | 23 | 11.3 | 0.05 |
| | 19 | ○ | x | ○ | x | ○ | 51 | 25 | 14.3 | 0.05 |
| | 20 | ○ | x | ○ | x | ○ | 45 | 60 | 25.8 | 0.23 |
| | 21 | ○ | x | ○ | x | ○ | 62 | 61 | 30.5 | 0.35 |
| | 22 | ○ | x | ○ | x | ○ | 55 | 27 | 25.6 | 0.30 |
| | 23 | ○ | x | ○ | x | ○ | 25 | 50 | 31.1 | 0.20 |
| | 24 | ○ | x | ○ | x | ○ | 18 | 70 | 28.3 | 0.25 |

| Classification | Test No. | [N]/(% CaO) | [N]/WCA | Conformance to equation (1) | Conformance to equation (2) | Conformance to equation (3) | Crack area ratio (%) | Cleanliness |
|---|---|---|---|---|---|---|---|---|
| Inventive Example | 1 | 1.167 | 700 | ○ | ○ | ○ | 0 | 1.00 |
| | 2 | 0.933 | 840 | ○ | ○ | ○ | 0 | 0.95 |
| | 3 | 0.923 | 800 | ○ | ○ | ○ | 0 | 0.82 |
| | 4 | 1.800 | 771 | ○ | ○ | ○ | 0 | 1.08 |
| | 5 | 1.000 | 750 | ○ | ○ | ○ | 0 | 0.93 |
| | 6 | 0.706 | 218 | ○ | ○ | ○ | 0 | 1.01 |
| | 7 | 0.613 | 253 | ○ | ○ | ○ | 0 | 1.09 |
| | 8 | 0.586 | 273 | ○ | ○ | ○ | 0 | 0.95 |
| | 9 | 0.600 | 140 | ○ | ○ | ○ | 0 | 1.20 |
| | 10 | 1.941 | 660 | ○ | ○ | ○ | 0 | 1.11 |
| | 11 | 0.329 | 200 | ○ | ○ | ○ | 0 | 0.98 |
| | 12 | 1.911 | 542 | ○ | ○ | ○ | 0 | 1.07 |
| | 13 | 1.300 | 975 | ○ | ○ | x | 0 | 1.14 |
| | 14 | 1.257 | 880 | ○ | ○ | x | 0 | 0.98 |
| | 15 | 0.631 | 195 | ○ | ○ | x | 0 | 1.13 |

TABLE 3-continued

| | | | | | | | | |
|---|---|---|---|---|---|---|---|---|
| Comparative Example | 16 | 2.111 | 950 | x | ○ | x | 1.0 | 1.75 |
| | 17 | 2.143 | 900 | x | ○ | x | 1.2 | 1.65 |
| | 18 | 2.043 | 940 | x | ○ | x | 3.5 | 1.88 |
| | 19 | 2.040 | 1020 | x | ○ | x | 4.5 | 1.44 |
| | 20 | 0.750 | 196 | ○ | x | x | 5.0 | 1.85 |
| | 21 | 1.016 | 177 | ○ | x | x | 2.3 | 2.10 |
| | 22 | 2.037 | 183 | x | x | x | 3.8 | 1.95 |
| | 23 | 0.500 | 125 | x | x | x | 4.7 | 1.77 |
| | 24 | 0.257 | 72 | x | x | x | 5.1 | 1.91 |

In the description of the column of classification in this Table, "Inventive Example" indicates being within the scope of the invention described in claim 1 and "Comparative Example" indicates being outside the scope of the invention described in claim 1. In this Table, the "mark ○" in Steps 1 to 5 shows that the treatment of relevant Step was performed, while the "mark x" not. The "mark ○" in each conformance to equations (1) to (3) indicates that the relevant equation was satisfied, while the "mark x" not. In addition, the "amount of Ca addition" is an amount of addition of genuine Ca in the form of CaSi alloy.

Additionally, the "cleanliness index" in this Table is a numerical value normalized by setting the number of inclusions in Test No. 1 as the criterion (1.0). Here, the number of inclusions was determined by observing the sample surface of 314 $mm^2$ under an optical microscope and totaling the number of inclusions having a size of 5 μm or more.

In Test Nos. 1 to 7, steel for a steel pipe was produced by a production method that satisfies any of conditions specified in claim 3 and conditions specified in claim 4. In Test Nos. 8 to 12, the melting and refining were carried out by a melting and refining method that satisfies the conditions specified in claim 3, but does not satisfy the conditions specified in claim 4, i.e., by only carrying out the processes of Steps 1, 3 and 5.

Moreover, Test Nos. 13 to 15 are tests that steel is melted and refined by the melting and refining method that satisfy neither conditions specified in claim 4, i.e., by only carrying out the processes of Steps 1, 3 and 5, nor conditions specified in claim 3.

In addition, Test Nos. 1 to 15 above all are tests of Inventive Examples that carried out the method of producing steel for a steel pipe, satisfying requirements described in claim 1 including the relations of equations (1) and (2).

On the other hand, Test Nos. 16 to 24 are tests of Comparative Examples that do not satisfy the requirements described in claim 4, i.e., only the processes of Steps 1, 3 and 5 being carried out, and that show steel made without adopting the method specified in claim 3, and yet that cannot satisfy any one of the relations of equations (1) and (2) specified in claim 1.

Test Nos. 1 to 15 that are Inventive Examples satisfying the requirements described in claim 1 turn out that good steel for a steel pipe having no HIC at all was produced. In particular, in Test Nos. 1 to 7 satisfying the requirements of both claims 3 and 4, extremely good steel for steel pipes exhibiting particularly excellent HIC resistance performance and cleanliness were produced.

On the other hand, in Test Nos. 16 to 23 that are Comparative Examples not satisfying the requirements of claim 1, the steel thus produced is poor in HIC resistance performance and its crack area ratio (CAR) showed a comparatively high value of 1 to 5%.

From the above results, it has been ascertained that satisfying the requirements of claim 1 greatly stabilizes the HIC resistance performance of high strength HIC resistant steel and makes it possible to lead to the production of steel for steel pipes including line pipes excellent in sour-resistance performance.

Additionally, the comparison of the results of Test Nos. 8 to 15 with the results of Test Nos. 16 to 24 shows that steel excellent in HIC resistance performance are obtained by satisfying the conditions specified in claim 1 even if the conditions specified in claim 3 or 4 are not satisfied. On the other hand, as seen from the results of Test Nos. 1 to 7 above, it has been ascertained that satisfying the requirements of both claims 3 and 4 makes it possible to stably produce steel for steel pipes exhibiting both particularly excellent HIC resistance performance and extremely high cleanliness.

INDUSTRIAL APPLICABILITY

According to the method of producing steel for steel pipes of the present invention, high-strength HIC resistant steel for steel pipes further improved in sour-resistance performance can be stably and inexpensively manufactured by optimizing the addition of a CaO-type flux, the gas stirring of molten steel and flux, the supply of an oxidizing gas, and the Ca addition into molten steel. In high-strength HIC resistant steel for steel pipes manufactured by the inventive method, low sulfur, low nitrogen and high cleanliness by virtue of inclusions control have been achieved, so that the inventive steel is optimal as steel for steel pipes including line pipes that requires sour-resistance performance. Therefore, the present invention can be widely applied, on the basis of excellent economical efficiency, in the refinement and steel pipe producing areas as technology that can stably supply high-strength HIC resistant steel with high performance.

What is claimed is:

1. A method of producing steel for a steel pipe excellent in sour-resistance performance, wherein the steel comprises, in % by mass, C: 0.03 to 0.4%, Mn: 0.1 to 2%, Si: 0.01 to 1%, P: 0.015% or less, S: 0.002% or less, Ti: 0.2% or less, Al: 0.005 to 0.1%, Ca: 0.0005 to 0.0035%, N: 0.01% or less, and O (oxygen): 0.002% or less, the balance being Fe and impurities, the method comprising controlling the amount of Ca addition charged into the steel that is molten in a ladle according to a N content in the molten steel prior to Ca addition, wherein non-metallic inclusions in the steel are mainly composed of Ca, Al, O, and S, and, as a result of the controlling step, a CaO content in the inclusions is in the range of 30 to 80%, the ratio of the N content in the steel to the CaO content in the inclusions satisfies the relation expressed by equation (1), and a CaS content in the inclusions satisfies the relation expressed by equation (2), $$0.28 \leqq [N]/(\%\ CaO) \leqq 2.0 \quad (1)$$

$$(\%\ CaS) \leqq 25\% \quad (2)$$

where [N] represents the mass content (ppm) of N in the steel, (% CaO) represents the mass content (%) of CaO in the inclusions, and (% CaS) represents the mass content (%) of CaS in the inclusions wherein in order to control a presence of inclusions such that carbonitrides such as Ti, Nb, and the like are formed on surfaces of CaO—CaS—$Al_2O_3$ inclusions, Ca is added such that in controlling the amount of Ca addition into the molten steel in the ladle, the ratio of the N content in molten steel to the amount of Ca addition to the molten steel satisfies the relation expressed by equation (3) below according to the N content in the molten steel prior to the Ca addition:

$$200 \leqq [N]/WCA \leqq 857 \quad (3)$$

where [N] represents the mass content (ppm) of N in the molten steel prior to the Ca addition and WCA represents the amount of Ca addition (kg/t-molten steel) to the molten steel.

2. The method of producing steel for a steel pipe excellent in sour-resistance performance according to claim 1, wherein the molten steel is treated by the steps indicated by Steps 1 to 4 and then the Ca is added in Step 5:

Step 1: CaO-type flux is added to molten steel in a ladle at atmospheric pressure;

Step 2: after Step 1, the molten steel and the CaO flux are stirred by injecting a stirring gas into the molten steel in the ladle at atmospheric pressure, and also an oxidizing gas is supplied to the molten steel to thereby mix the CaO-type flux with an oxide generated by the reaction of the oxidizing gas with the molten steel;

Step 3: the supply of the oxidizing gas is halted and desulfurization and removal of inclusions are carried out by injecting a stirring gas into the molten steel in the ladle at atmospheric pressure;

Step 4: an oxidizing gas is supplied into an RH vacuum chamber to increase the molten steel temperature when the molten steel in the ladle is treated using an RH degasser after step 3, and subsequently the supply of the oxidizing gas is halted, and then circulation of the molten steel within the RH degasser is continued to remove inclusions in the molten steel; and Step 5: metallic Ca or a Ca alloy is added to the molten steel in the ladle after Step 4.

* * * * *